US008578522B1

(12) United States Patent
Helmstetter et al.

(10) Patent No.: US 8,578,522 B1
(45) **Date of Patent: *Nov. 12, 2013**

(54) SYSTEM AND METHOD FOR CONTROLLING, DRAINING, REMOVING, AND DISPOSING OF LIQUIDS AND LIGHT SOLIDS

(75) Inventors: Michael Helmstetter, Metairie, LA (US); Donald Mosley, Metairie, LA (US)

(73) Assignee: Michael F. Helmstetter

( * ) Notice: Subject to any disclaimer, the term of this patent is extended or adjusted under 35 U.S.C. 154(b) by 916 days.

This patent is subject to a terminal disclaimer.

(21) Appl. No.: 12/491,319

(22) Filed: Jun. 25, 2009

Related U.S. Application Data

(63) Continuation-in-part of application No. 11/624,195, filed on Jan. 17, 2007, now Pat. No. 7,621,002.

(60) Provisional application No. 60/772,689, filed on Feb. 13, 2006.

(51) Int. Cl.
*E03D 11/00* (2006.01)

(52) U.S. Cl.
USPC ..... 4/252.1

(58) Field of Classification Search
USPC ..... 4/252.1–6; 285/56–60, 64, 66; 137/247.33, 247.41, 362
See application file for complete search history.

(56) References Cited

U.S. PATENT DOCUMENTS

| | | | | |
|---|---|---|---|---|
| 4,227,722 | A * | 10/1980 | Barber | 285/56 |
| 5,220,694 | A * | 6/1993 | Knorovsky | 4/252.4 |
| 6,883,187 | B2 * | 4/2005 | Cornwall | 4/252.5 |
| 7,621,002 | B1 * | 11/2009 | Helmstetter et al. | 4/252.1 |

* cited by examiner

*Primary Examiner* — Lori Baker
(74) *Attorney, Agent, or Firm* — Andrew G. Vicknair

(57) ABSTRACT

A method and system for controlling, draining, removing, and disposing of liquids and light solids. This enables liquids and/or light solids to be drained centrally, such as underneath a toilet through the sewer pipe, without having to worry about sewerage gasses escaping into the location of the drain. In addition, individuals that may have problems using an ordinary shower and/or bath tub, such as the elderly, the handicapped, and/or disabled may use the system to simplify the bathing process by taking a shower while remaining in a wheel chair and/or by sitting on a toilet without having to get into a tub and/or shower whereby any liquids and/or light solids from the shower will be allowed to drain underneath the toilet.

10 Claims, 17 Drawing Sheets

SYSTEM AND METHOD FOR CONTROLLING, DRAINING, REMOVING, AND DISPOSING OF LIQUIDS AND LIGHT SOLIDS

CROSS REFERENCE TO RELATED APPLICATIONS

This is a Continuation-In-Part application relying on applicants' previously filed application Ser. No. 11/624,195 filed on Jan. 17, 2007, which claims the benefit of U.S. provisional patent application Ser. No. 60/772,689 filed on Feb. 13, 2006.

TECHNICAL FIELD OF INVENTION

The present invention relates, in general to drainage systems and disposing of liquids and light solids in various locations, including, but not limited to, residential and commercial locations and environments, such as through utilization of outlet piping, such as the soil pipe, outlet pipe, sewer line pipe, or any drain pipe, connected to toilets, bathtubs, and other fixtures

BACKGROUND OF INVENTION

Draining liquids and light solids may appear to be a simple concept with no room for improvement. However, various obstacles exist in certain settings and various circumstances that may hinder or limit drainage. While sinks, toilets and other fixtures provide for drainage, such fixtures provide drainage for limited activities in limited areas and sometimes clog and/or the flow becomes obstructed thereby leading to an overflow situation whereby liquids and/or light solids overflow out of the fixture, such as the toilet, tub, shower, sink, and the like onto the surrounding area. For example, a toilet and a tub provide for drainage of liquids and light solids within the tub and toilet. Nearly all individuals regularly associated with toilets, sinks, and other fixtures are familiar with the consequences of and problems created by an overflow situation, such as liquids and/or light solids leaking on the floor when a sink, bathtub, and/or toilet overflows. For example, FIG. 1 illustrates a typical toilet and its drainage system.

When an apparatus, such as a toilet, tub or sink overflow, the liquids and any light solids will ultimately flow out of the apparatus and onto the surrounding structures, such as a countertop, floor, wall, and the like. When an overflow occurs, one ultimately has to clean up all liquids and light solids that have overflown and moved out onto the surrounding structures, barriers and environment. Frequently, overflow situations may lead to damage, such as wet, warped, and physically altered flooring, walls, cabinets, wood work, base boards, and the like. For example, the effects of an overflown toilet onto a wooden floor and/or sub-floor may lead to a disfigured, warped, swollen, buckled, rotten and/or destroyed floor underneath the toilet.

FIG. 1 illustrates a typical toilet and its drainage system. As illustrated in FIG. 1, toilet 100 sits on floor 120 which is on top of sub-floor 130. Bolts 110 secure toilet 100 to floor 120 and sub-floor 130. Floor 120 is usually some type of material commonly used in bathrooms, such as linoleum, tile, ceramic, marble, and/or wood. Floor 120 is usually installed on top of sub-floor 130, which may be concrete slab for a bathroom on the first floor of a typical house or some type of wood material, such as plywood, for a bathroom located on the first floor of a raised house and/or a bathroom located on the first or second floor of a typical house. The drainage system of toilet 100 includes wax ring 140, flange 150, and sewer pipe 160.

Wax ring 140 is positioned between toilet 100 and flange 150 whereby wax ring 140 surrounds the base of toilet 100, helps prevent toilet leakage from reaching sub-floor 130 and helps direct flow from the toilet into flange 150 and into sewer pipe 160. Thus, when a toilet is flushed, liquids and light solids exit toilet 100, pass through wax ring 140, into flange 150 and then into sewer pipe 160. In an ideal situation, toilet 100 will not clog and/or back up and drainage of liquids and light solids will flow into sewer pipe 160 with no leakage. However, it is commonplace for toilets, such as toilet 100, to become clogged so that any liquids and light solids that are prevented from draining through toilet 100 will back up and ultimately spill out of the toilet and onto the surrounding area, such as floor 120. When this occurs, the liquids and light solids will spill out of the toilet and flow over the surrounding area because there is no where for the liquids and light solids to drain. Such an overflow can lead to many problems. For example, some of the liquids and light solids that have spilled out of the toilet may reach various components located near the toilet, such as walls, cabinets, wood working and trim, furniture and the like, and may ultimately leak through a surrounding area, such as floor 120, and eventually reach the sub-floor, such as sub-floor 130, and cause various types of damage, such as rotting and/or warping the sub-floor, destroying the sub-floor, staining the sub-floor, wetting the sub-floor, and the like.

While items exist to help prevent and minimize overflow situations, such as plungers, a pipe snake, chemical clog removers, and various other plumbing tools, such items do not guarantee the elimination of overflow situations. Thus, individuals will continually be presented with the threat and occurrence of overflow situations and drainage clogs. Accordingly, someone will also continually be responsible for the task of cleaning up any liquids and/or light solids that overflow from an apparatus, such as a toilet, sink, tub, and the like onto a surrounding barrier such as floor 120 because of an overflow situation.

In addition to overflows and drainage clogs, current day drainage apparatuses and fixtures do not adequately account for condensation, water seepage, and many other problems, where liquids and light solids must be controlled to prevent problems. Further, current day drainage apparatuses and fixtures, such as tubs and showers, do not fully accommodate individuals with special needs, such as wheel chair patients, the elderly, the disabled, and other people who have difficulty when using the restroom and/or taking a shower and/or bath. For example, it is often difficult for the elderly, the disabled, and wheel chair patients to take a bath and/or shower on their own; often those individuals require some form of external assistance, such as the help of a nurse or aid, in order to take a shower and/or bath.

Accordingly, a need exists in the art for a system and method that provides for controlling, draining, removing, and disposing of liquids and light solids in various locations to help reduce and/or eliminate damage resulting from overflow situations whereby liquids and/or light solids spill over onto the floor causing damage. A further need exists for systems and methods that enable and/or aid the elderly, the disabled and handicapped individuals in using the restroom and/or taking a bath and/or shower with little to no help from a third party, such as a nurse and/or aid. Thus, various embodiments of the present invention will reduce the number of problems and amount of damage associated with overflow situations and will make it possible for and/or assist in enabling and/or aiding the elderly, the disabled and handicapped individuals so that these individuals may use the restroom and/or take a bath and/or shower with little to no help from a third party. For example, if an overflow situation occurs, or if an elderly, handicapped or disabled individual were to take a shower while sitting on a toilet, then any liquids and light solids that flow onto a surrounding area because of the overflow situation or due to the shower will be able to drain off of the surrounding area through the use of an embodiment of the present invention without the need for any quick cleanup of the liquids and light solids that have collected on the surrounding area.

BRIEF SUMMARY OF THE INVENTION

These and other objects, features and technical advantages are achieved by systems and methods for controlling, draining, removing, and disposing of liquids and light solids with the use of various specialized drainage trap systems. The specialized drainage trap system may be configured in several flavors. In one embodiment, the specialized drainage trap system may employ a reshaped floor and/or sub-floor and an inner chamber flange apparatus wherein the floor and/or sub-floor is adapted so that it declines towards the location of a toilet in a room, such as a bathroom, hospital room, and the like, and the inner chamber flange apparatus will be installed in a drainage pipe, such as a sewer pipe, before the installation of a typical toilet flange. The typical toilet flange may then be installed over/into the inner chamber flange apparatus so that a trap system is created. The toilet may then be installed to the typical toilet flange at an elevated position above the reshaped floor so that there is room for any liquids and light solids that may spill onto the floor from an overflow situation to drain underneath the base of the toilet through the specialized drainage trap system. This may also enable those who have difficulty using a standard tub and/or shower to take a shower while sitting on a wheel chair, bath chair, or on the toilet without having to get into a standard tub and/or shower, because any liquids and/or light solids from the shower will simply drain underneath the toilet through the specialized drainage trap system.

In another embodiment of the present invention, the specialized drainage trap system may employ a specialized mat that fits over the floor, a customized flange bowl with perforations and a trap system wherein the specialized mat is shaped and/or graduated so that it declines towards the location of a toilet in a room. In such an embodiment, the customized flange bowl is installed over a drainage pipe, such as a sewer pipe. A toilet may then be installed directly to the customized flange bowl so that the perforations in the customized flange bowl may be located outside of the perimeter of the base of the toilet so that any liquids and/or light solids that flow onto the mat will drain from the mat and towards the toilet so that the liquids and/or light solids will drain through the perforations and through the trap system of the customized flange bowl and into the sewer pipe. This may also enable those who have difficulty using a standard tub and/or shower to take a shower while sitting on a wheel chair, bath chair, or on the toilet without having to get into a standard tub and/or shower because any liquids and/or light solids from the shower will simply drain from the mat and underneath the toilet through the specialized drainage trap system.

In another embodiment of the present invention, the specialized drainage trap system may employ a reshaped floor, a depressioned sub-floor, and a customized flange trap including a base, a drainage ring and a platform whereby the drainage ring, platform and base form a trap like system. The reshaped floor declines towards the location of a toilet in a room and the sub-floor is configured so that a depression is cut into the sub-floor. In such an embodiment, the base of the customized flange trap is preferably located in the depression of the sub-floor and over the drainage pipe, such as the sewer pipe. The drain ring and platform portions of the customized flange trap may then be installed over the depression and onto the base of the customized flange trap. The toilet is then installed onto the platform whereby the customized flange trap is configured so that the drain ring is located outside of the base of the toilet so that any liquids and/or light solids that flow onto the graduated floor may drain from the floor and towards the toilet so that the liquids and/or light solids will drain through the drain ring and through the trap like system of the customized flange trap and then into the sewer pipe. This may also enable those who have difficulty using a standard tub and/or shower to take a shower while sitting on a wheel chair, bath chair, or on the toilet without having to get into a standard tub and/or shower, because any liquids and/or light solids from the shower will simply drain from the graduated floor and underneath the toilet through the a customized flange trap system.

In another embodiment of the present invention, the specialized drainage trap system may employ a reshaped floor, a depressioned sub-floor, and a customized bowl-shaped trap wherein the bowl-shaped trap is installed underneath the base of a toilet into the depression of the sub-floor. The customized bowl-shaped trap may also be configured so that it includes a plurality of drain holes that are preferably located at the top of the bowl-shaped trap near the base of the toilet. The customized bowl shaped trap may be integrated as part of a toilet so that the toilet and bowl shaped trap are one or more pieces that are integrated with one another. In such an embodiment, the toilet is configured so that feet are located at the bottom of the toilet to raise the toilet off of the floor to provide room for drainage underneath the base of the toilet and into the plurality of drain holes of the bowl-shaped trap. In addition, the reshaped floor declines towards the location of a toilet in a room and the sub-floor is configured so that a depression is cut into the sub-floor so that the customized bowl shaped trap can be installed in said depression. Any liquids and/or light solids that flow onto the graduated floor may drain from the floor and towards the toilet so that the liquids and/or light solids will drain through the drain holes and through the trap like system of the customized bowl shaped trap and then into the sewer pipe. This may also enable those who have difficulty using a standard tub and/or shower to take a shower while sitting on a wheel chair, bath chair, or on the toilet without having to get into a standard tub and/or shower, because any liquids and/or light solids from a shower will simply drain from the graduated floor and underneath the toilet feet and into the customized bowl shaped trap.

In another embodiment of the present invention, the specialized drainage trap system may employ a reshaped floor and/or a level floor with a graduated mat, a depressioned sub-floor, and a customized flange trap with a flange member and a base member wherein the base member is installed underneath the base of a toilet into the depression of the sub-floor. The customized flange trap may also be configured so that it includes mounting locations for the toilet to mount to the base member. In such an embodiment, the toilet is configured so that it is installed at an elevated height above the floor to provide room for drainage underneath the toilet and into the base member of the customized flange trap.

A technical advantage of the present invention is provided so that when liquids and light solids flow onto a surrounding area because of an overflow situation, the liquids and light solids will be able to drain off of the surrounding area through the use of an embodiment of the present invention. For example, if an individual is using the restroom and the toilet clogs and/or overflows, liquids and lights solids that spill out of the toilet onto the surrounding area, such as the bathroom floor, will drain underneath the toilet and into the sewer pipe so that the individual will not have to panic and/or hurry up in an attempt to stop the overflowing liquids and light solids from traveling all over the surrounding area. In addition, if an individual were taking a bath and somehow the tub backed up and water overflowed out of the tub onto the surrounding area, such as the floor, the present invention would allow liquids and/or light solids flowing out of the tub to drain through the embodiments of the present invention instead of the liquids and/or light solids spreading over the surrounding area causing damage.

A further technical advantage provided by the various embodiments of the present invention is the assistance, aid, and additional choices associated with the acts of taking a bath and/or shower provided to various individuals, such as the elderly, handicapped, and/or disabled individuals. The present invention assists, enables, and/or helps the elderly, the disabled and handicapped individuals to use the restroom and/or take a bath and/or shower with little to no help from a third party. Currently, elderly individuals who require the assistance of an individual to take a shower and/or bath must likely be moved from his/her current location and brought into a shower/bathtub to take a shower/bath. Problems often arise as a majority of showers and bathtubs are configured such that the elderly, disabled, and/or handicapped individual must be physically picked up and relocated over the side wall and/or side lip of a shower/bathtub and positioned onto some type of chair/bench so that the elderly individual can take his/her bath within the limited space of the bath tub and/or shower. With the present invention, an elderly, disabled, and/or handicapped individual can take a shower near the installation of the present invention, such as taking a shower while sitting in a wheel chair, in a bath chair and/or bench, or on a toilet away from the tub and/or shower, without having to be picked up over the side wall and/or side lip of a shower/bathtub. The elderly individual can sit nearly anywhere near the location of the installation of the present invention and take a shower. For example, an elderly, disabled, and/or handicapped individual can now sit on the toilet, a wheel chair, bench, or in a bath chair near the location of the installation of the present invention, without having to be confined to the physical boundaries of a modern day shower and/or bathtub, and take a shower because the liquids and/or light solids, such as water, resulting from the individual taking a shower outside of the physical boundaries of a shower and/or tub will hit the floor and drain through the specialized drainage trap systems of the embodiments of the present invention. All water resulting from the shower will drain through the specialized drainage trap. The present invention adds a multi-functional drainage system in the floor of the room where it is installed, such as a bathroom, in addition to the normal drain located in a bathtub and/or shower. Now the elderly, the disabled and handicapped individuals who often can not position themselves into a bath and/or shower may now take a shower without having to get into a tub and/or shower.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated that the conception and specific embodiment disclosed may be readily utilized as a basis for modifying or designing other structures for carrying out the same purposes of the present invention. It should also be realized that such equivalent constructions do not depart from the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Referring now in more detail to the drawings, a few embodiments of the present invention will now be described in more detail.

Figure 1:
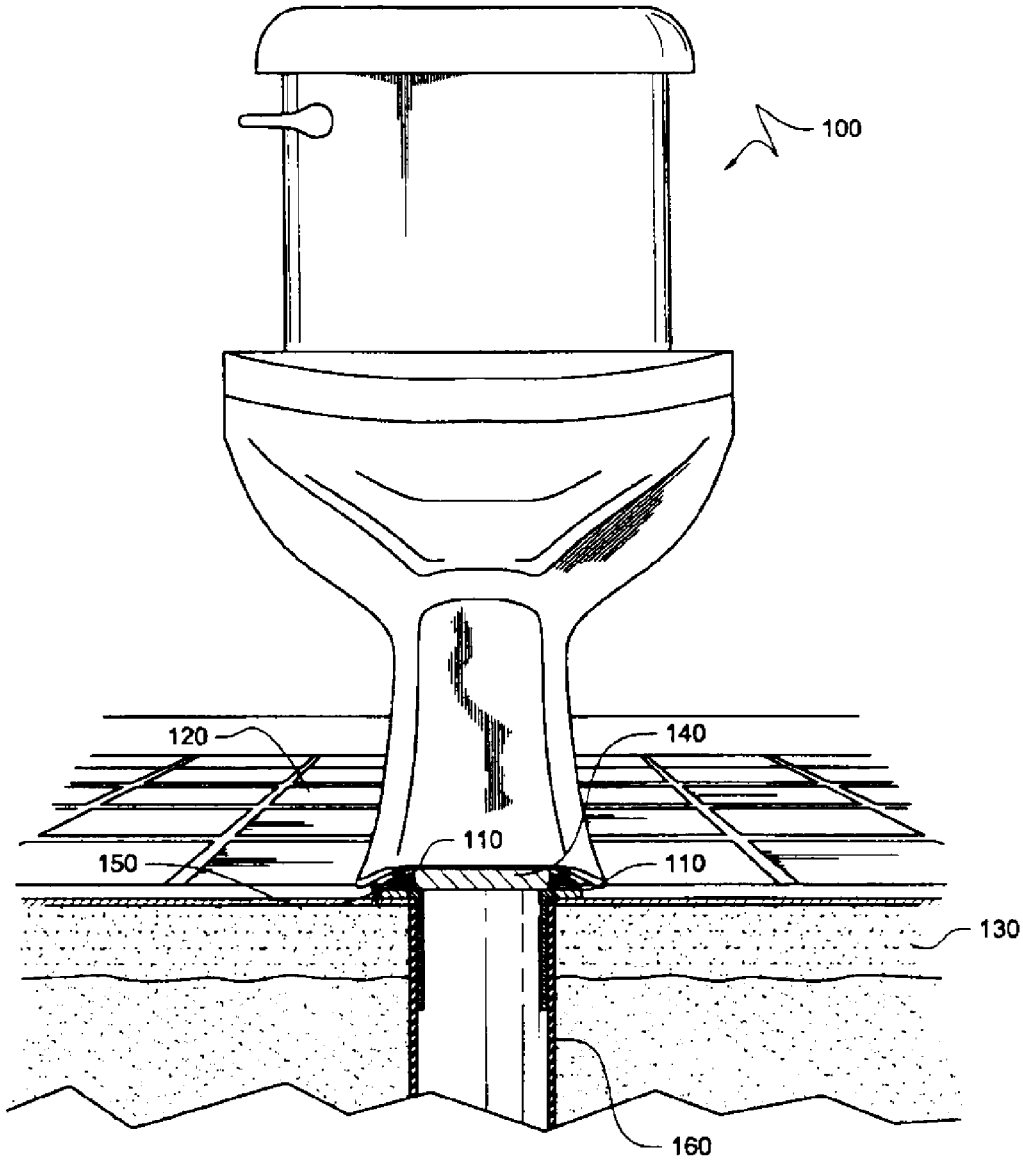
FIG. 1 (Prior Art)
FIG. 1 is an illustration of a toilet and its drainage system.
Figure 2A:
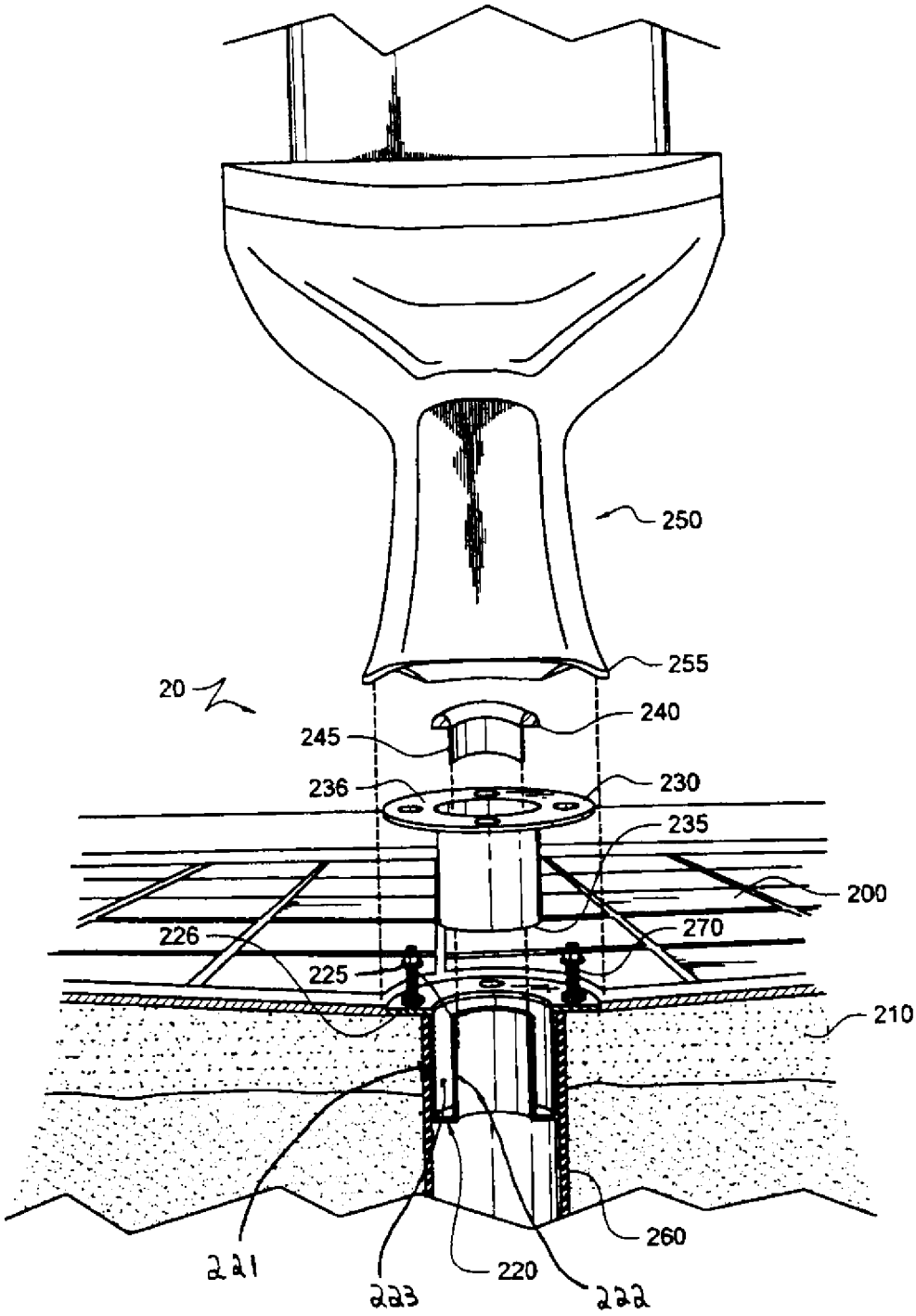
FIG. 2A is an exploded view of one embodiment of the present invention.

One embodiment of the present invention illustrated in FIG. 2A may utilize a reshaped floor and/or sub-floor wherein the floor and/or sub-floor is shaped to decline towards the base of a toilet and an inner chamber flange apparatus that is installed in a drainage pipe, such as a sewer pipe. A toilet flange may then be installed over/into the inner chamber flange apparatus so that a specialized trap system is created. A toilet is then installed to the toilet flange at an elevated height above the reshaped floor and/or sub-floor so that there is space for liquids and/or light solids to drain underneath the toilet because it is installed at an elevated height above the reshaped floor and/or sub-floor. For example, liquids and/or light solids that may spill onto the floor from an overflow situation and liquids and/or light solids on the floor as a result of an elderly, handicapped, or disabled individual taking a shower without getting into a tub and/or shower while sitting on a toilet, a wheel chair, bath chair, and the like located outside of a tub and/or shower can now flow towards the base of the toilet due to the declined-reshaped floor and eventually drain underneath the base of the toilet through the specialized drainage trap system.

The various embodiments of the present invention allow an elderly, handicapped, or disabled who has difficulty using an ordinary tub and/or shower to take a shower outside of a tub and/or shower in a room, such as a bathroom, where the floor is configured so that liquids, such as water, will not destroy the floor. For example, the floor of the room may be configured with some type of tile, marble, or other water resistant material or a specialized mat, such as a plastic or rubber mat, may be installed over the floor so that water will come in contact with the mat and not the floor. In such a room where the floor is configured so that water will not injure the floor, an individual who has problems using an ordinary tub and/or shower may sit on a stool, a bath chair, a wheel chair, or on a toilet in a bathroom, and the like located outside of the typical tub and/or shower and use some type of hose connected to a water supply, such as a typical shower hose with a shower head, and take a shower outside of the tub and/or shower so that the liquids and/or light solids, such as water, from the shower will simply fall to the floor during the course of the shower. When the liquids and/or light solids fall the floor, the embodiments of the present invention will enable the liquids and/or light solids to drain towards the location of the specialized trap systems of the present invention and ultimately drain into the trap systems and then into a drainage pipe. Thus, the present invention enables individuals to at least take a shower outside of a typical tub and/or shower because the liquids and/or light solids can drain through the present invention.

FIG. 2A illustrates an exploded view of one embodiment of a specialized drainage trap system of the present invention. The specialized drainage trap system 20 may employ a reshaped floor 200 and/or sub-floor 210, an inner chamber flange apparatus 220, and a toilet flange 230 wherein the floor 200 and/or sub-floor 210 is adapted so that it declines towards the location of drainage/sewer pipe 260 and toilet 250. Inner chamber flange apparatus 220 will be installed in drainage pipe 260, such as a sewer pipe, before the installation of toilet flange 230. Toilet flange 230 may then be installed over and/or into inner chamber flange apparatus 220 so that a trap system is created. The creation of the trap system is beneficial as it provides an alternative method of draining liquids and/or light solids while preventing sewerage gasses, such as gasses originating from a drainage and/or sewer pipe, from entering the area where the present invention is installed. For example, the installation of the embodiment of the present invention illustrated in FIG. 2A will operate as a trap system and prevent sewerage gasses from escaping out of drainage pipe 260 so that the sewerage gasses will be prevented from entering the room where the present invention is installed.

Figure 2B:
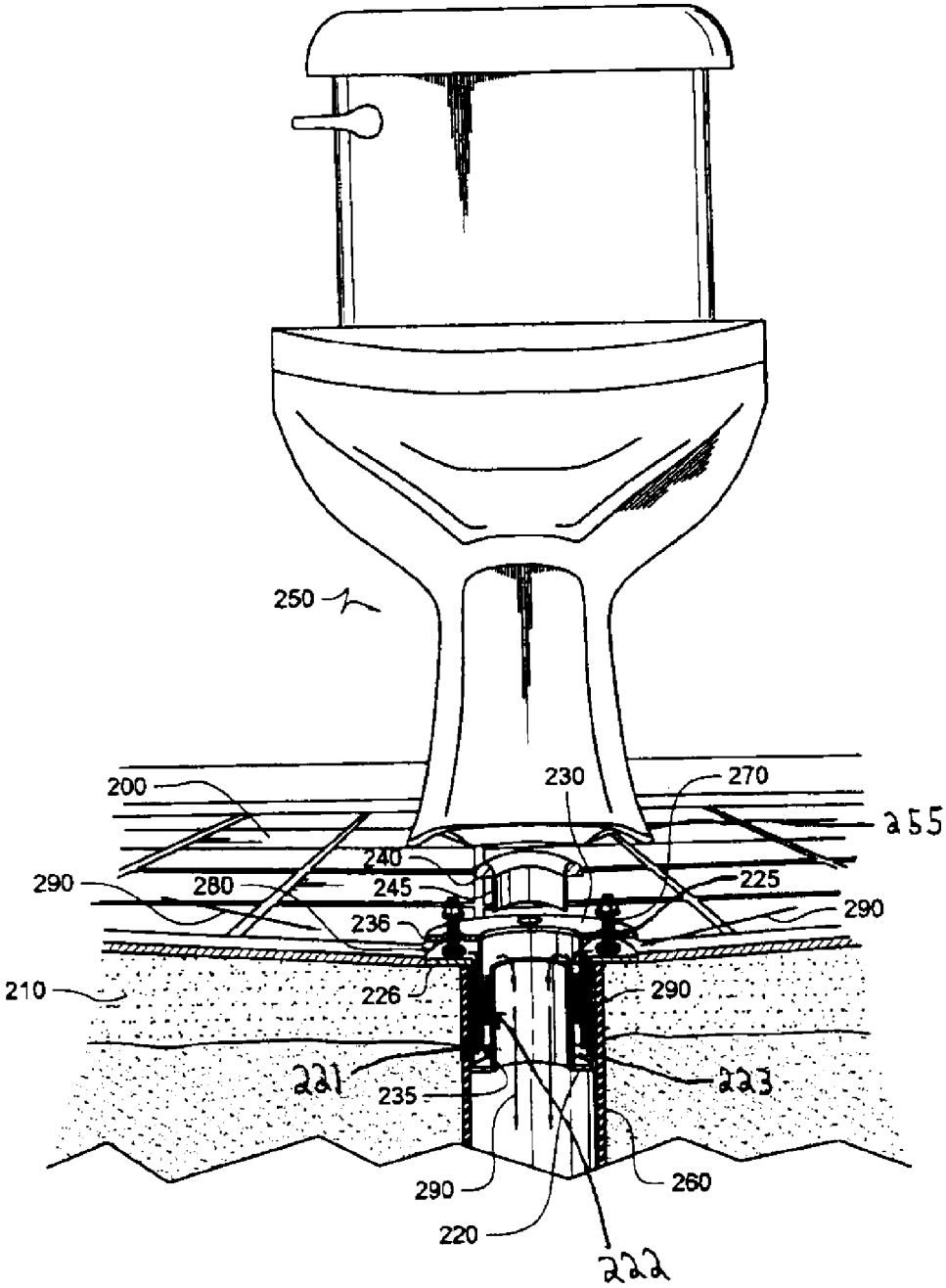
FIG. 2B is a non-exploded view of FIG. 2A.

Inner chamber flange apparatus 220 may be a flange like apparatus with a specialized chamber 223 located between outer wall member 221 and inner wall member 222 of inner chamber flange apparatus 220 wherein inner wall member 222 stops at a top position 225 that is below the lip 226 of inner chamber flange apparatus 220 as illustrated in FIG. 2A. Toilet flange 230 is a flange like apparatus that is sized to fit into inner chamber flange apparatus 220 as illustrated in FIGS. 2A and 2B. Toilet flange 230 and inner chamber flange apparatus 220 may be fabricated out of any number of materials, such as plastic, stainless steel, chrome, iron, Hastelloy® metal, titanium, polyvinyl chloride (PVC), copper, aluminum, clay, ceramic, porcelain, and the like.

When toilet flange 230 is installed over and/or into inner chamber flange apparatus 220 as illustrated in FIG. 2B, toilet flange 230 and inner chamber flange apparatus 220 are configured so that there is a space 280 between the lip 236 of toilet flange 230 and the lip 226 of inner chamber flange apparatus 220. The result of this configuration is that although toilet flange 230 is installed into inner chamber flange apparatus 220, lip 236 of toilet flange 230 is elevated and/or raised above lip 226 of inner chamber flange apparatus 220 as illustrated by space 280 in FIG. 2B. The size of space 280 is not limited to any specific size and may be configured so that it is any number of sizes, such a 1/16 of an inch, 1/8 of an inch, 3/16 of an inch, 1/4 of an inch, 3/8 of an inch, 1/2 of an inch, and the like. The illustration of the sizes listed is merely an illustration and is not a limitation of the present invention. Space 280 provides room for liquids and/or light solids to drain through to drainage pipe 260 as further explained below.

While toilet flange 230 and inner chamber flange apparatus 220 are illustrated in FIG. 2A as two separate pieces, the present invention is not limited to this configuration. In alternative embodiments, inner chamber flange apparatus 220 and toilet flange 230 may comprise one single piece. In another embodiment, inner chamber flange apparatus 220 and toilet flange 230 may be permanently mounted to one another through any number of means, such as welded together, screwed together, and the like. Regardless of how inner chamber flange apparatus 220 and toilet flange 230 are connected or installed, they are preferably configured so that toilet flange 230 is elevated and/or raised above inner chamber flange apparatus 220 as illustrated by space 280 in FIG. 2B.

After toilet flange 230 is installed over and/or into inner chamber flange apparatus 220, toilet wax ring seal 240 may then be installed between toilet 250 and toilet flange 230. In a preferred embodiment, toilet wax ring seal 240 may include some type of plastic insert, such as insert 245, that extends down past the top position 225 of inner wall member 222 of inner chamber flange apparatus 220 to aid in directing flow of liquids and light solids from toilet 250 past top position 225 and into drainage pipe 260. The extension of plastic insert 245 is of such a length that flow from toilet 250 can not back flow into specialized chamber 223. Thus, in a preferred embodiment, when toilet 250 is flushed, any flow out of toilet 250 will drain out of toilet 250 and flow directly into drainage pipe 260 without any flow from toilet 250 entering chamber 223 of inner chamber flange apparatus 220 because plastic insert 245 extends down past the top position 225 of inner wall member 222 of inner chamber flange apparatus 220 thereby preventing any flow from toilet 250 from entering into chamber 223 of inner chamber flange apparatus 220.

Toilet 250 may then be installed over toilet wax ring seal 240, over toilet flange 230 and inner chamber flange apparatus 220 with bolts 270. Bolts 270 may be mounted to sub-floor 210, inner chamber flange apparatus 220, and/or toilet flange 230. When toilet 250 is installed, it is installed at an elevated height so that there is a space between toilet base 255 and floor 200. With toilet 250 installed at an elevated position above floor 200, there is space for any liquids and/or light solids that may reach floor 200 from an elderly, disabled, and/or handicapped individual taking a shown while sitting on toilet 250 or on another device or for any liquids and/or light solids that may spill onto floor 200 from an overflow situation to flow underneath base 255 of toilet 250 through space 280 into the specialized drainage trap system of the present invention.

FIG. 2B is a non-exploded view of FIG. 2A that illustrates the flow of liquids and/or light solids according to an embodiment of the present invention. In an overflow situation involving a toilet, a toilet, such as toilet 250, is stopped up and/or clogged so that liquids and/or light solids in the toilet back up and eventually spill out of the toilet and onto the surrounding area, such as floor 200. When an overflow situation occurs, liquids and/or light solids that spill onto floor 200 will eventually flow toward base 255 of toilet 250 as illustrated by flow arrows 290 of FIG. 2B because floor 200 is reshaped. Because toilet 250 is installed at an elevated position above floor 200, there is room for liquids and/or light solids to flow underneath base 255 of toilet 250 through space 280. Thus, the liquids and/or light solids will flow underneath base 255 of toilet 250 and through space 280 and into the specialized drainage trap system of the present invention.

Because toilet flange 230 and inner chamber flange apparatus 220 are configured with a space 280 between lip 236 of toilet flange 230 and lip 226 of inner chamber flange apparatus 220, the liquids and/or light solids on floor 200 will flow underneath base 255 of toilet 250 and then underneath lip 236 of toilet flange 230 and over lip 226 of inner chamber flange apparatus 220 and into chamber 223 of inner chamber flange apparatus 220 as illustrated by flow arrows 290. The flow of liquids and/or light solids will flow through space 280 and into chamber 223 of inner chamber flange apparatus 220 until the liquids and/or light solids reach the bottom 235 of toilet flange 230. After the liquids and/or light solids reach the bottom 235 of toilet flange 230, the liquids and/or light solids will flow up towards top position 225 of inner wall member 222 of inner chamber flange apparatus 220, and then the liquids and/or light solids will flow over inner wall member 222 at top position 225 and into drainage pipe 260. The flow of liquids and/or light solids through the inner chamber flange apparatus 220 will not interfere with the normal flow through toilet 250 into drainage pipe 260 from the normal operation of the toilet.

When the flow of liquids and/or light solids from floor 200 stops, the liquids and/or light solids will eventually stop flowing through space 280 and through inner chamber flange apparatus 220. In a preferred embodiment, when the flow stops, a small amount of liquids and/or light solids may be left in chamber 223 of inner chamber flange apparatus 220. This is advantageous because the remaining liquids and/or light solids left in chamber 223 function to help prevent any sewerage gasses, such as sewerage gasses coming from drainage/sewer pipe 260, from traveling back through inner chamber flange apparatus 220 and entering into the room where the present embodiment may be installed. Thus, sewerage gasses will be prevented from entering into the room where the present invention is located.

The present embodiment of the present invention may also be configured to include a flush system to flush the specialized drainage trap system of the present invention, such as the system illustrated in FIGS. 2A and 2B. The flush system will preferably operate to periodically flush some type of liquid, through the specialized drainage trap system, such as flushing water through chamber 223. The periodic flushing of liquids, such as water, detergents, bleach, toilet cleaners, sanitizers, and the like will help to eliminate odors from the present embodiment, help to maintain the cleanliness of the specialized drainage trap system, and help to assist in keeping chamber 223 moist to assist in preventing sewerage gases from backing up from drainage pipe 260 into the area where the present invention may be installed. The flush system may be configured in a variety of manners as it may be tied to the flushing mechanism on a toilet so that every time the toilet is flushed, the specialized drainage trap system will also be flushed. In an alternative embodiment, the flush system may be configured so that the flush system is on a timer so that every so often the specialized drainage trap system will be periodically flushed, regardless of when the toilet is flushed.

The present invention is not limited to the reshaping of the floor and/or sub-floor as illustrated in FIGS. 2A and 2B, as an embodiment of the present invention may be configured so that any type of graduated mat or object may be used instead of reshaping the floor. The graduated mat may be one that is permanently installed over the floor or used as needed. In such an embodiment, a graduated mat or other object, configured so that it declines toward the drainage pipe, may be placed over the floor so that when any liquids and/or light solids spill onto the graduated mat, such as when an individual decides to take a shower while sitting on a toilet outside of the tub and/or shower, the liquids and/or light solids will flow toward the toilet and flow under the toilet and through inner chamber flow apparatus 220 as described above.

Figure 3A:
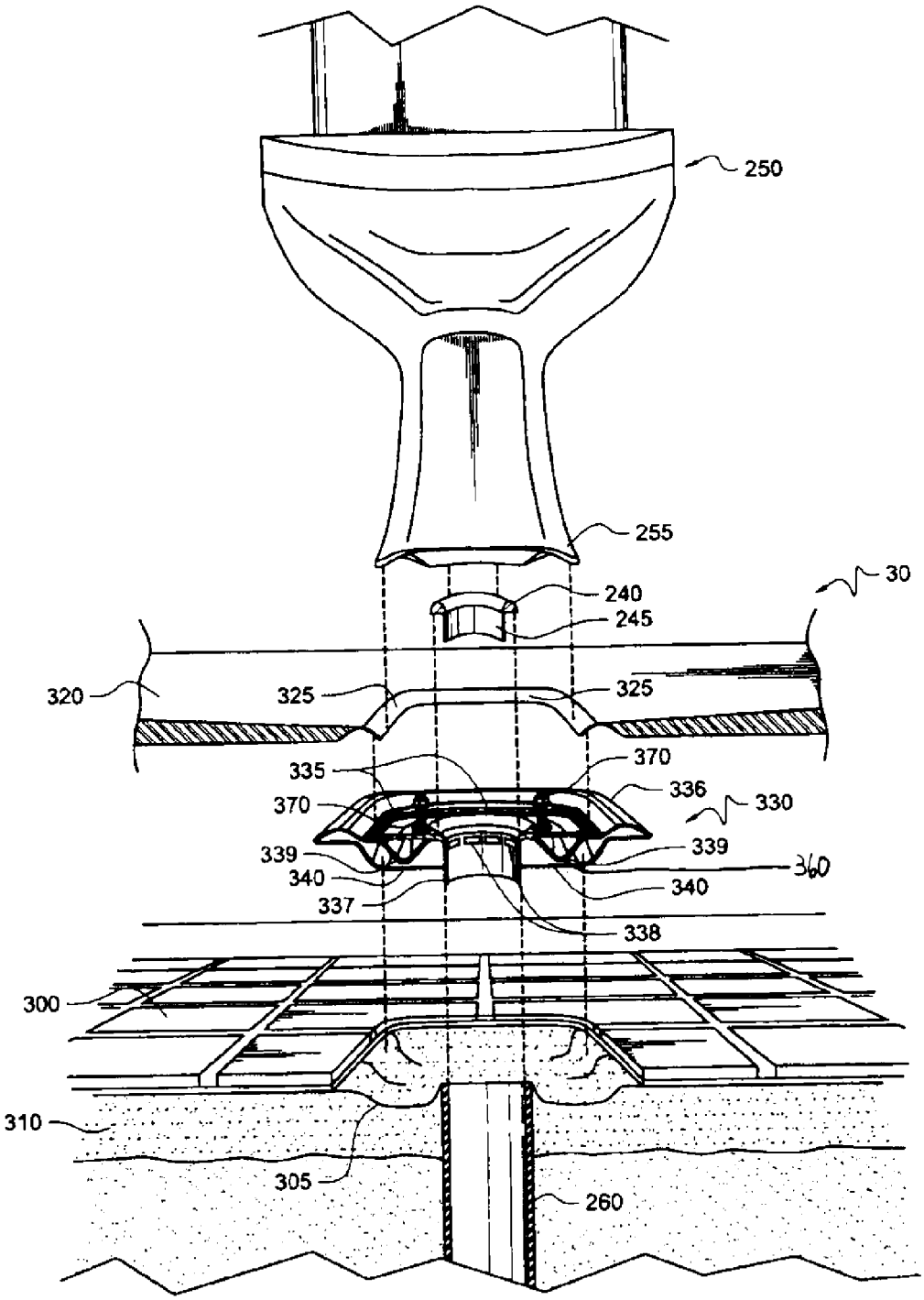
FIG. 3A is an exploded view of another embodiment of the present invention.

Another embodiment of the present invention illustrated in FIG. 3A may utilize a specialized mat that fits over the floor, a customized flange bowl with perforations and a trap system wherein the specialized mat is shaped and/or graduated so that it declines towards the location of a toilet and/or a drain in a room. In such an embodiment, the customized flange bowl may be installed over a drainage pipe, such as a sewer pipe. A toilet may then be situated so that it installs over and/or to the customized flange bowl whereby the perforations in the customized flange bowl may be located outside of the perimeter of the base of the toilet. Thus, any liquids and/or light solids on the specialized mat as a result of an overflow situation involving an overflowing toilet, sink, bathtub, and/or the like or any liquids and/or light solids on the floor as a result of an elderly, handicapped, or disabled individual taking a shower, while sitting on a toilet, a wheel chair, bath chair, and the like without getting into a tub and/or shower, will flow on the mat and towards the toilet so that the liquids and/or light solids can drain through the perforations and through the trap system of the customized flange bowl and into the sewer pipe.

FIG. 3A illustrates an exploded view of one embodiment of a specialized drainage trap system of the present invention. The specialized drainage trap system 30 may employ a specialized mat 320 that fits over floor 300, a customized flange bowl 330 with perforations 335 wherein the specialized mat 320 is shaped and/or graduated so that it declines towards the location of drainage pipe 260 and toilet 250. Customized flange bowl 330 includes perforations 335, outer lip 336, inner flange piece 337 with drainage holes 338, and trap extension member 339. The bottom of customized flange bowl 330 is illustrated by 340. The components of customized flange bowl 330 may be configured as one piece or multiple pieces that are attached to one another. Customized flange bowl 330 may be configured out of any number of materials of varying thicknesses, such as metal, rubber, plastic, steel, chrome, PVC, iron, aluminum, and the like.

The present invention may be configured so that customized flange bowl 330 may be installed in a manner such that it is sunk into a depression 305 located in sub-floor 310 as illustrated in FIG. 3A so that the outer lip 336 of customized flange bowl 330 sits on top of floor 300 when installed. Thus, if customized flange bowl 330 were installed into a new construction, then floor 300 and sub-floor 310 would be configured to account for the installation of customized flange bowl 330; and if customized flange bowl 330 were installed into a pre-existing construction, then parts of floor 300 and sub-floor 310 may be removed to provide space for customized flange bowl 330 to be installed. Thus, floor 300 and sub-floor 310 may be configured in either a new construction or pre-existing construction so that customized flange bowl 330 may be sunk below floor 300 and down into sub-floor 310 so that outer lip 336 sits on floor 300 while bottom 340 may be set into sub-floor 310. However, the present invention is not limited to this configuration as optional configurations may be utilized.

Figure 3B:
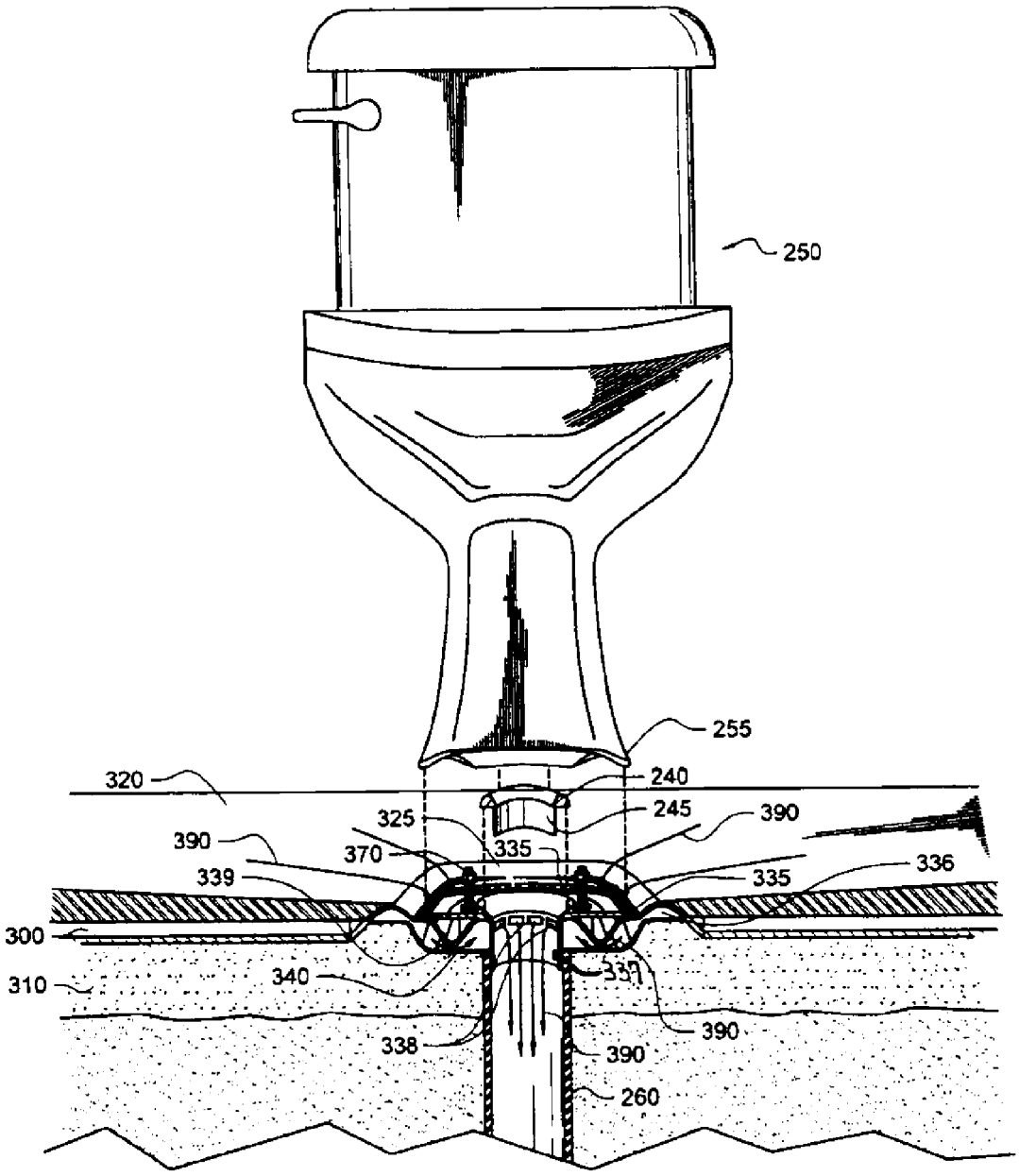
FIG. 3B is a non-exploded view of FIG. 3A.

Specialized mat 320 may be configured to fit over floor 300 and is configured so that it is graduated to decline down towards customized flange bowl 330 as illustrated in FIGS. 3A and 3B. By declining towards customized flange bowl 330 and towards base 255 of toilet 250, any liquids and/or light solids which may spill over onto mat 320, such as liquids and/or light solids from toilet 250, an overflowing tub, sink, or from someone taking a shower while located outside of a tub and/or shower, such as an elderly, disabled, or handicapped individual sitting in a wheel chair located on mat 320 and the like, will flow towards the base 255 of toilet 250. Specialized mat 320 may be installed prior to or after installation of customized flange bowl 320. Specialized mat 320 may be configured to include a slanted inner lip 325 to further assist drainage of liquids and/or light solids from mat 320 into drainage pipe 260. Specialized mat 320 may be configured in any number of shapes and sizes and out of any number of materials, such as plastic, rubber, silicone and the like.

Specialized mat 320 may also be configured so that inner lip 325 is a portion of specialized mat 320 that may be configured to sit on top of and/or fit over outer lip 336 of customized flange bowl 330 so that when specialized mat 320 is installed and/or placed over floor 300, inner lip 325 of specialized mat 320 will sit on top of outer lip 336 of customized flange bowl 330 or the area near outer lip 336 of customized flange bowl 330 as illustrated in FIGS. 3A and 3B. The configuration and/or arrangement of inner lip 325 sitting on top of outer lip 336 assists in making sure that liquids and/or light solids flowing toward customized flange bowl 330 will flow down towards perforations 335 and through customized flange bowl 330 without backing up and flowing under specialized mat 320.

Perforations 335 are a series of holes in customized flange bowl 330 that are located to the inside of outer lip 336. Although FIG. 3A represents a cut view of drainage trap system 30, customized flange bowl 330 continues with another half similar to the half illustrated in FIG. 3A. Thus, perforations 335 continue around the entire surface of customized flange bowl 330. Customized flange bowl 330 may take the form of any number of shapes, such as circular, rectangular, oblong, and the like. Thus, regardless of the shape of customized flange bowl 330, perforations 335 will continue around the entire surface of customized flange bowl 330. For example, if customized flange bowl 330 were configured in the shape of a circle, perforations 335 would continue three-hundred and sixty degrees around the circular customized flange bowl 330. Outer lip 336 extends outward from perforations 335 and extends all the way around the outside of perforations 335. Trap extension member 339 is a member that extends down underneath perforations 335 and is located underneath perforations 335 as illustrated in FIGS. 3A and 3B. Trap extension member 339 assists in providing trap system functionality to the present invention and extends around the entirety of customized flange bowl 330.

Inner flange piece 337 may be located in the center of customized flange bowl 330 and extends down into drainage pipe 260 when the present embodiment is installed as illustrated in FIG. 3B. In a preferred embodiment, inner flange piece 337 is configured with a plurality of drainage holes 338. Drainage holes 338 of inner flange piece 337 are located in the side walls of inner flange piece 337 and are located all around the side walls of inner flange piece 337 as illustrated in FIGS. 3A and 3B. Inner flange piece 337 functions similar to a typical flange and the configuration and arrangement of inner flange piece 337 and drainage holes 338 help provide a passage way for liquids and/or light solids passing from toilet 250 and for any liquids and/or light solids draining through perforations 335 to drain into sewer pipe 260. Drainage holes 338 are not limited to any particular size or shape and may be located in any array and/or alignment around the sidewalls of inner flange piece 337.

Trap extension member 339 is an extension member that may extend from underneath perforations 335 towards bottom 340 of customized flange bowl 330. In a preferred embodiment of the present invention, trap extension member 330 will not extend all the way down to the bottom 340 of customized flange bowl 330 because a space 360, illustrated in FIG. 3A, is left between trap extension member 339 and bottom 340 of customized flange bowl 330 to allow for the passage of liquids and/or light solids to pass underneath trap extension member 339 through space 360 as illustrated in FIGS. 3A and 3B. Trap extension member 339 may comprise any number of a variety of materials of varying thicknesses, such as metal, rubber, plastic, steel, chrome, PVC, iron, aluminum, and the like. The combination of perforations 335 and trap extension member 339 function to provide trap system functionality to customized flange bowl 330. The configuration of trap extension member 339 in conjunction with the arrangement of perforations 335 and outer lip 336 of customized flange bowl 330 are such that the configuration of these components help provide a trap system that will help to prevent any sewerage gases, such as gasses from sewer pipe 260, from escaping out of sewer pipe 260 and passing up through perforations 335. Such prevention is helpful because it aids in preventing unpleasant odors from passing through perforations 335 and into whatever room drainage trap system 30 may be located.

FIG. 3B is a non-exploded view of FIG. 3A that illustrates the flow of liquids and/or light solids according to an embodiment of the present invention. As illustrated in FIG. 3B, customized flange bowl 330 has been installed and specialized mat 320 has been installed over floor 300 such that inner lip 325 of specialized mat 320 fits over outer lip 336 of customized flange bowl 330. FIG. 3B illustrates toilet wax ring seal 240 above inner flange piece 337 of customized flange bowl 330 for ease of view so that drainage holes 338 are visible. After customized flange bowl 330 has been installed, toilet wax ring seal 240 may then be installed into inner flange piece 337 of customized flange bowl 330 between toilet 250 and inner flange piece 337. In the present embodiment, toilet wax ring seal 240 may include some type of plastic insert, such as insert 245, that helps to direct flow of liquids and/or light solids from toilet 250 down past drainage holes 338 through inner flange piece 337 and into sewer pipe 260. Insert 245 may be configured in the present embodiment so that when toilet wax ring seal 240 and insert 245 are installed into inner flange piece 337, insert 245 extends down below drainage holes 338. Insert 245 extends down past drainage holes 338 so that when liquids and/or light solids flow from toilet 250, the flow will continue down through insert 245 through inner flange piece 337 past drainage holes 338 so that the flow from toilet 250 can not flow back through drainage holes 338 because insert 245 extends down past drainage holes 338.

Toilet 250 may then be installed over toilet wax ring seal 240 and over inner flange piece 337 of customized flange bowl 330 with bolts 370. Bolts 370 may be mounted to customized flange bowl 330, floor 300 and/or to sub-floor 310. As illustrated in FIGS. 3A and 3B, customized flange bowl 330 is sized so that when toilet 250 is installed, toilet base 255 of toilet 250 sits to the inside of perforations 335. Thus, perforations 335 will surround the outside of toilet base 255. With customized flange bowl 330 sized so that toilet base 255 sits inside of perforations 335, liquids and/or light solids that may spill onto specialized mat 320 from an overflow situation or from a shower situation and the like will flow toward toilet 250 and flow down through perforations 335 before ever reaching toilet base 255.

When liquids and/or light solids gather on specialized mat 320 as a result of an overflow situation involving an overflowing toilet, sink, bathtub, and/or the like or any liquids and/or light solids gather on specialized mat 320 as a result of individual taking a shower, while sitting on a toilet, a wheel chair, bath chair, and the like without getting into a tub and/or shower and the embodiment illustrated in FIGS. 3A and 3B is installed, the liquids and/or light solids may eventually flow towards toilet 250 as illustrated by flow arrows 390 of FIG. 3B. The liquids and/or light solids may flow towards toilet 250 because specialized mat 320 is a graduated mat and/or a mat that is installed at a graduated position so that specialized mat 320 declines toward toilet 250. With perforations 335 surrounding toilet base 255, liquids and light solids may flow on specialized mat towards toilet 250 and may flow over inner lip 325 of specialized mat 320 and through perforations 335. At perforations 335, liquids and/or light solids may then flow down through perforations 335 of customized flange bowl 330.

After flowing through perforations 335, any liquids and/or light solids that pass through perforations 335 will continue to flow down and under trap extension member 339 through space 360 as illustrated by flow arrows 390. After flowing through space 360 under trap extension member 339, flow of liquids and/or light solids will continue to flow up toward the underside of inner flange piece 337. When the level of liquids and/or light solids rises up to drainage holes 338, then the liquids and/or light solids will pass through drainage holes 338 and then down into sewer pipe 260.

When the flow of liquids and/or light solids from specialized mat 320 stops, the liquids and/or light solids will eventually stop flowing through space perforations 335, space 360, and drainage holes 338. In a preferred embodiment, when the flow stops, a small amount of liquids and/or light solids may be left in space 360 of customized flange bowl 330. This is advantageous because the remaining liquids and/or light solids left in space 360 function to help prevent any sewerage gasses, such as sewerage gasses coming from drainage/sewer pipe 260, from traveling back through customized flange bowl 330 and entering into the room where the present embodiment may be installed. Thus, sewerage gasses will be prevented from entering into the room where the present invention is located.

The present embodiment of the present invention may also be configured to include a flush system to flush the specialized drainage trap system of the present embodiment of the present invention, such as the system illustrated in FIGS. 3A and 3B. The flush system may operate to periodically flush some type of liquid, through the specialized drainage trap system, such as flushing water through perforations 335 and space 360 of customized flange bowl 330. The periodic flushing of liquids, such as water, detergents, bleach, toilet cleaners, sanitizers, and the like, will help to eliminate odors from the present embodiment, help to maintain the cleanliness of the specialized drainage trap system, and help to assist in keeping space 360 of customized flange bowl 330 moist to assist in preventing sewerage gases from backing up from drainage pipe 260 into the area where the present invention may be installed. The flush system may be configured in a variety of manners as it may be tied to the flushing mechanism on a toilet so that every time the toilet is flushed, the specialized drainage trap system will also be flushed. In an alternative embodiment, the flush system may be configured so that the flush system is on a timer so that every so often the specialized drainage trap system will be periodically flushed, regardless of when the toilet is flushed.

Figure 4A:
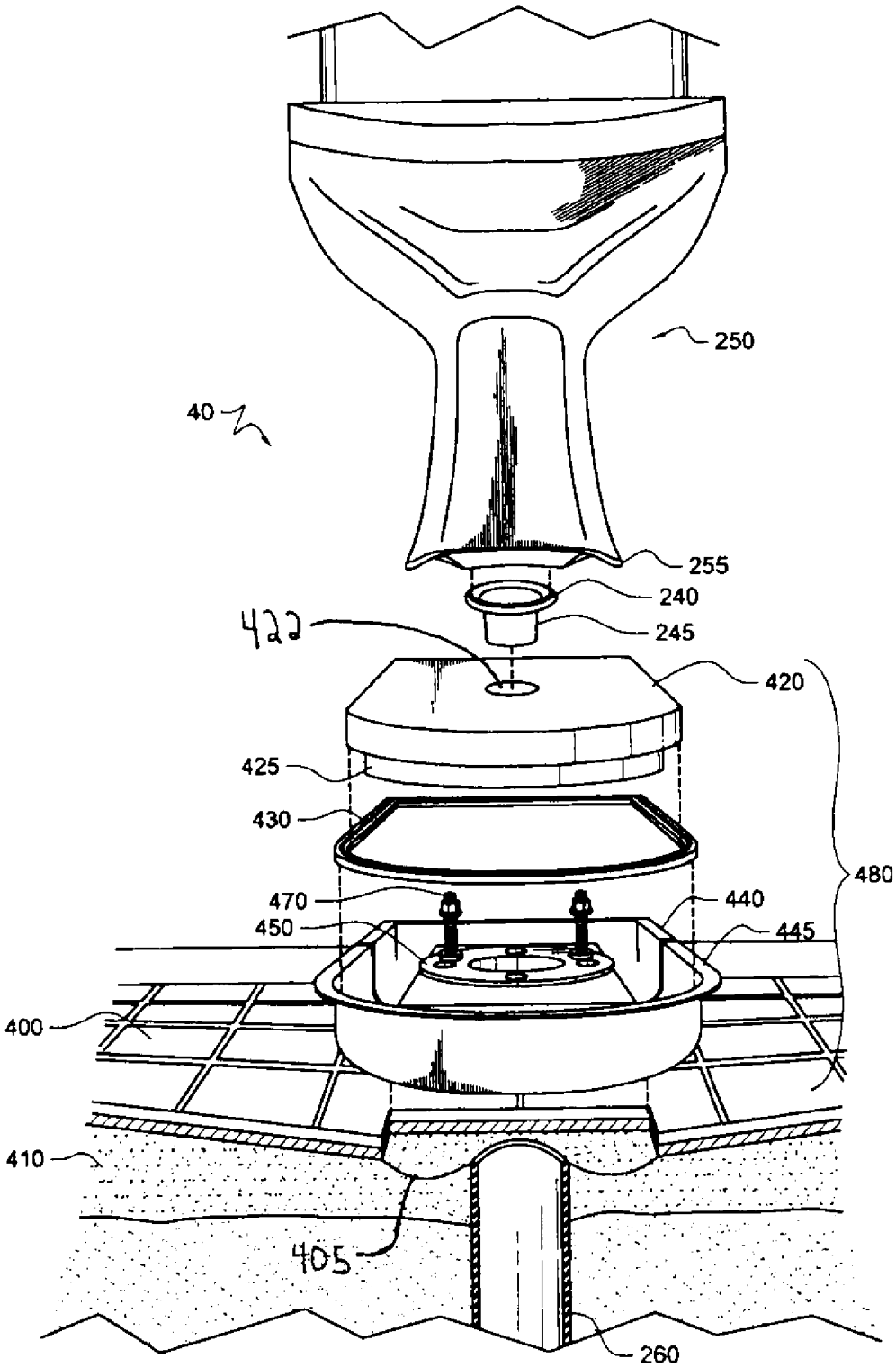
FIG. 4A is an exploded view of another embodiment of the present invention.

Another embodiment of the present invention illustrated in FIG. 4A may utilize a specialized drainage trap system which may employ a reshaped floor, a depressioned sub-floor, and a customized flange trap including a base, a flange, a drainage ring and a platform whereby the drainage ring, platform and base form a trap like system. The reshaped floor is configured so that it is graduated to decline towards the location of a drainage pipe and/or toilet and the sub-floor is configured so that a depression is cut into the sub-floor. In such an embodiment, the base of the customized flange trap may be installed and/or fixated in the depression of the sub-floor. The drain ring and platform portions of the customized flange trap may then be installed on the base of the customized flange trap. The toilet is then installed on and/or to the platform whereby the customized flange trap is configured so that the drain ring is located outside of the base of the toilet so that any liquids and/or light solids on the reshaped floor may drain from the floor and towards the toilet so that the liquids and/or light solids will drain through the drainage ring into the base and then into the sewer pipe.

FIG. 4A illustrates an exploded view of one embodiment of a specialized drainage trap system of the present invention. The specialized drainage trap system 40 may employ a reshaped floor 400, a depressioned sub-floor 410, and a customized flange trap 480 including a base 440, an inner flange piece 450 with a pipe member that extends downward, a drainage ring 430 and a platform 420 whereby the drainage ring 430, platform 420 and base 440 assist in forming a trap like system. Reshaped floor 400 may be configured so that floor declines toward base 255 of toilet 250. However, the present embodiment is not limited to this configuration as the present embodiment may utilize a graduated mat, similar to mat 320 of FIGS. 3A and 3B, that is installed over a floor that has not been reshaped.

Sub-floor 410 is preferably configured with a depression 405 cut into sub-floor 410 near sewer pipe 260, which provides drainage for toilet 250. The depression 405 is configured to provide enough room so that base 440 may be installed and/or positioned in the depression 405 cut into sub-floor 410. Thus, if customized flange trap 480 were installed into a new construction, then floor 400 and sub-floor 410 would be originally configured to account for the installation of base 440; and if customized flange trap 480 were installed into a pre-existing construction, then parts of floor 400 and sub-floor 410 may be removed to provide space for base 440 to be installed. Thus, customized flange trap 480 may be installed in either a new construction or pre-existing construction. In either situation, floor 400 and/or sub-floor 410 may be configured so that base 440 may be positioned below floor 400 and down into sub-floor 410.

Base 440 may take the shape of a bowl-like member as illustrated in FIG. 4A that is configured so that it can be installed in the depression 405 cut into sub-floor 410. However base 440 of the present invention is not limited to the configuration of a bowl like member as illustrated in FIG. 4A, as base 440 may take the form of any number of different shapes and sizes. When base 440 is installed in said depression 405, base 440 is preferably configured so that the center of base 440 is aligned with sewer pipe 260. Base 440 is not limited to any particular type of material as it may be configured out of any number of different types of materials, such as ceramic, marble, iron, steel, and the like. While base 440 is illustrated in FIG. 4A as one piece, the present invention is not limited to such configuration. In alternative embodiments, base 440 may comprise multiple pieces that connect together to form base 440. For example base 440 may comprise a front half and a back half that connect to one another to form one base 440.

Customized flange trap 480 also includes inner flange piece 450 that is preferably located in the center of base 440. However, the present invention is not limited to this configuration, as inner flange piece may be configured so that it is not located in the center of base 440. When base 440 is installed in the depression 405 of sub-floor 410, base 440 will be aligned with sewer pipe 260 so that inner flange piece 450 will align with sewer pipe 260 so that the bottom of inner flange piece 450 will extend down into sewer pipe 260. With the bottom of inner flange piece 450 extended down into sewer pipe 260, any drainage flowing through toilet 250 will eventually flow down through base 440 through inner flange piece 450 and down into sewer pipe 260. The present invention may also be configured so that inner flange piece 450 fits around the outside of sewer pipe 260 instead of extending down into sewer pipe 260. In such an embodiment, flow from toilet 250 would still flow down through base 440 and through inner flange piece 450 into sewer pipe 260. Inner flange piece 450 is preferably configured in such an embodiment so that it fits very tight around sewer pipe 260 so that there would be no leakage where inner flange piece 450 fits around the outside of sewer pipe 260. Inner flange piece 450 is not limited to any particular type of material as it may be configured out of any number of different types of materials, such as ceramic, marble, iron, steel, PVC, plastic, chrome, aluminum, and the like.

The present invention may be configured in such a manner that base 440 is sunk into sub-floor 410 at such a depth so that outer lip 445 of base 440 sits underneath reshaped floor 400. However, the present invention is not limited to this configuration as base 440 may also be installed in the depression 405 of sub-floor 410 at such a depth so that outer lip 445 of base 440 sits on top of floor 400 while the remaining portions of base 440 are underneath floor 400 in the depression 405 of sub-floor 410.

Customized flange trap 480 also includes drainage ring 430. Drainage ring 430 is preferably a ring shaped member of material with consecutive holes all the way around the ring shaped member of material. The drainage ring provides a location for liquids and/or light solids to drain into base 440 and eventually into sewer pipe 260. As in FIG. 4A, drainage ring 430 may take the shape of a circular like ring that is the same shape of base 440. However, the present invention is not limited to such configuration as drainage ring 430 may take the form of any number of shapes. In addition, drainage ring 430 may be configured as one piece or it may be multiples pieces that connect to one another. Further, drainage ring 430 is not limited to any particular type of material as it may be configured out of any number of different types of materials, such as ceramic, marble, iron, steel, PVC, plastic, chrome, aluminum, and the like.

Figure 4B:
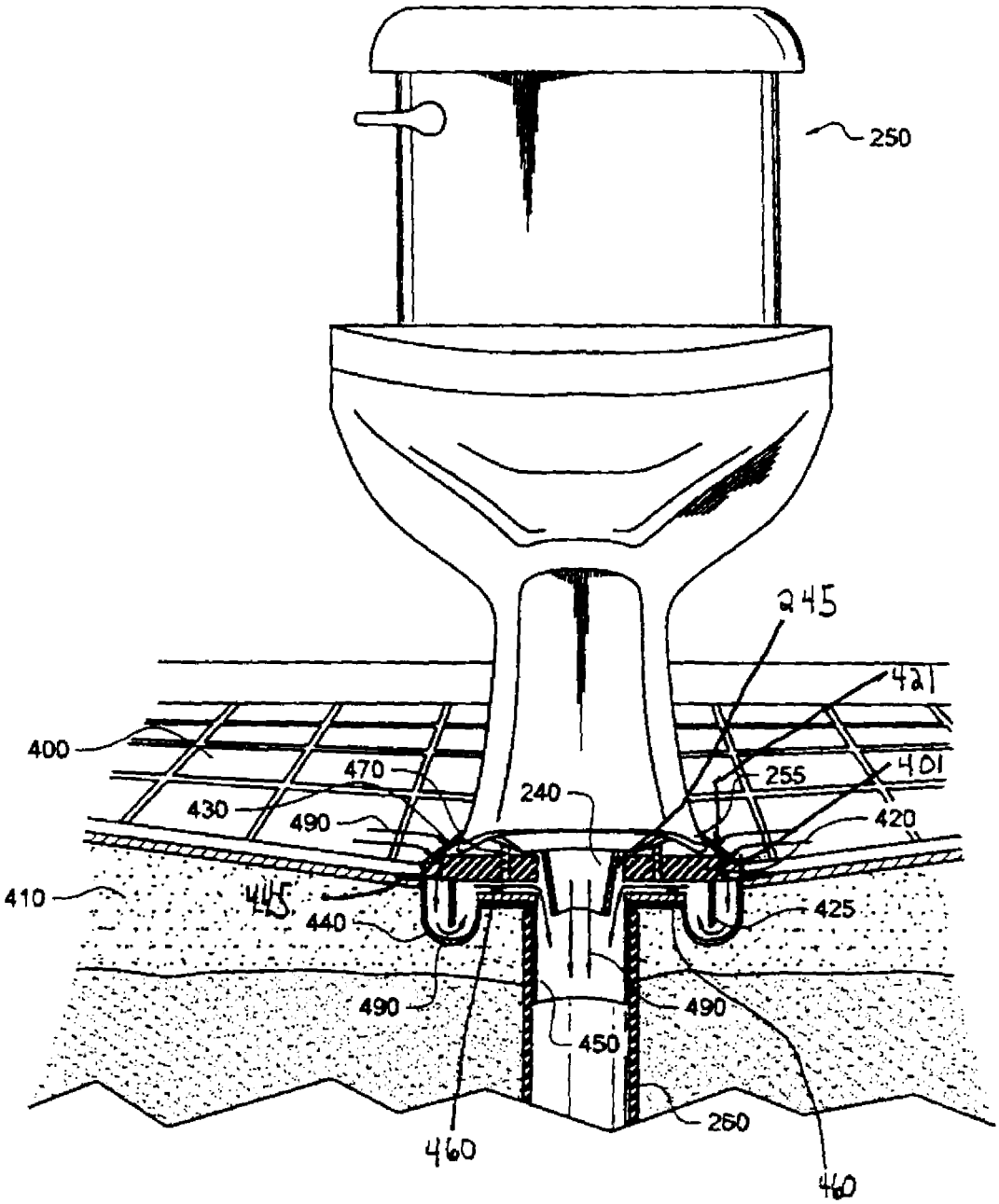
FIG. 4B is a non-exploded view of FIG. 4A.

In one embodiment, as illustrated in FIG. 4A, drainage ring 430 is sized so that its perimeter is larger than the perimeter of platform 420, and thus, drainage ring 430 sits outside of platform 420. In one embodiment, drainage ring 430 may be configured so that it is connected to lip 445 of base 440 in such a manner that liquids and/or light solids can still flow through drainage ring 430 without being obstructed by lip 445 of base 440. In such an embodiment, drainage ring 430 may install to lip 445 by any number of ways, such as snapping to lip 445, clipping to lip 445, and the like. As illustrated in FIG. 4B, when the present invention is configured so that outer lip 445 of base 440 sits underneath reshaped floor 400, then drainage ring 430 may be installed outside of platform 420 between outer edge 421 of platform 420 and outer edge 401 of floor 400. In another embodiment, the present invention may be configured so that drainage ring 430 is part of and/or connected to the platform 420.

Customized flange trap 480 also includes platform 420. Platform 420 provides a mounting location for toilet 250 and is configured with a hole 422 that extends from one side of platform 420 to the other side. Hole 422 provides for the drainage out of toilet 250 through platform 420 with the assistance of plastic insert 245 of toilet wax ring seal 240. Plastic insert 245 of toilet wax ring seal 240 extends down into hole 422 because hole 422 provides a drainage location for any liquids and/or light solids in toilet 250 to drain through and eventually reach sewer pipe 260. Plastic insert 245 is preferably configured so that it extends down into inner flange piece 450 at such a distance to assist in preventing the backflow of any liquids and/or light solids from toilet 250 from getting into base 440.

In a preferred embodiment, platform 420 is configured so that it takes a shape that is similar to the shape of base 440. In addition, an embodiment of the present invention may be configured so that the perimeter of platform 420 is smaller than the perimeter of drainage ring 430 and the perimeter of base 440 so that platform 420 can be positioned in base 440 with drainage ring 430 surrounding platform 420. Platform 420 is not limited to any particular thickness or shape, as platform 420 may be any number of shapes. In addition, platform 420 is not limited to any particular type of material as it may comprise any number of a variety of materials of varying thicknesses, such as ceramic, marble, granite, stone, quartz, iron, steel, chrome, aluminum, and the like.

As illustrated in FIG. 4A, platform 420 may also include trap extension member 425. Trap extension member 425 is an extension member that extends down from underneath platform 420, and although not illustrated in FIG. 4A, trap extension member 425 extends down all the way around the entire shape of platform 420. Trap extension member 425 may comprise any number of a variety of materials of varying thicknesses, such as ceramic, marble, granite, stone, quartz, metal, rubber, plastic, steel, chrome, PVC, iron, aluminum, and the like. The combination of platform 420 with trap extension member 425, drainage ring 430, and base 440 assist in providing trap system functionality to customized flange trap 480. In the present invention, the configuration of and positioning of platform 420 with trap extension member 425 in conjunction with the arrangement of drainage ring 430 and base 440 are such that the configuration of these components together help provide a trap system that will help to form a seal and prevent any sewerage gases from sewer pipe 260 from passing up through drainage ring 430. This sewerage gas seal is helpful because it prevents unpleasant odors from passing up out of sewer pipe 260 through drainage ring 430 and into the area where drainage trap system 40 may be located, such as a bathroom.

FIG. 4B is a non-exploded view of FIG. 4A that illustrates the flow of liquids and/or light solids according to an embodiment of the present invention. As illustrated in FIG. 4B, toilet 250, toilet wax ring seal 240 and customized flange trap 480 have been installed. Toilet 250, platform 420 and base 440 may be secured to one another with bolts 470. Prior to securing toilet 250 to platform 420, toilet wax ring seal 240 is preferably positioned between toilet 250 and platform 420. In the present embodiment, toilet wax ring seal 240 may include some type of plastic insert, such as insert 245, that extends into hole 422 and helps to direct flow of liquids and/or light solids or other substances from toilet 250 through platform 420, and through inner flange piece 450 and into sewer pipe 260. Insert 245 may be configured in the present embodiment so that when toilet wax ring seal 240 and insert 245 are positioned with insert 245 in hole 422 of platform 420, insert 245 extends down through platform 420 and into inner flange piece 450.

Toilet 250 may be installed over toilet wax ring seal 240 and over inner platform 420 and secured to platform 420 with bolts 470 or any number of connecting devices, such as screws, rods, and the like. Bolts 470 may be mounted to platform 420, base 440, and/or to sub-floor 410. As illustrated in FIG. 4B, base 440, platform 420, and drainage ring 430 are sized so that when toilet 250 is installed, toilet base 255 of toilet 250 sits on platform 420 which is inside of the perimeter of drainage ring 430 and inside of the perimeter of base 440. Thus, drainage ring 430 will surround the outside of toilet base 255. With platform 420 and base 440 sized so that toilet base 255 sits inside of the perimeter of drainage ring 430, liquids and/or light solids that may spill onto reshaped floor 400 and/or a specialized declined mat from an overflow situation or a shower situation will flow toward toilet 250 and flow down through drainage ring 430 before ever reaching toilet base 255.

When an overflow situation from a stopped up and/or clogged up toilet, sink, bathtub, and/or the like occurs, liquids and/or light solids may back up and eventually spill out of the toilet, tub, sink and the like and onto the surrounding area, such as reshaped floor 400. Likewise, when the present embodiment is installed, an individual may take a shower, while sitting on a toilet, a wheel chair, bath chair, and the like without getting into a tub and/or shower; in such a situation, liquids and/or light solids will likely gather on reshaped floor 400. When such an overflow and/or shower situation occurs, liquids and/or light solids that spill onto reshaped floor 400 may eventually flow towards toilet 250 as illustrated by flow arrows 490 of FIG. 4B because reshaped floor 400 is graduated to decline toward toilet 250. Likewise, if floor 400 was not reshaped, and a graduated mat was installed over floor 400, the liquids and/or light solids on the graduated mat would also eventually flow towards toilet 250. With drainage ring 430 surrounding toilet base 255, liquids and light solids may flow on reshaped floor 400 or a graduated mat towards toilet 250 and may flow through drainage ring 430.

After flowing through drainage ring 430, any liquids and/or light solids that pass through drainage ring 430 will continue to flow down and under trap extension member 425 as illustrated by flow arrows 490. After flowing under trap extension member 425, flow of liquids and/or light solids will continue to flow up toward the underside of platform 420 and through trap channels 460 and into sewer pipe 260. The positioning and arrangement of drainage trap system 40 as shown in FIG. 4B illustrates that plastic insert 245 of toilet wax ring seal 240 extends down through platform 420 and into inner flange piece 450 at such a distance as to not interfere with any flow from reshaped floor 400. Insert 245 assists in preventing said interference because insert 245 extends down past trap channels 460 so that when liquids and/or light solids flow from toilet 250, the flow will continue down through insert 245, through platform 420, and into inner flange piece 450 such that the flow from toilet 250 can not flow back through trap channels 460 and can thus not interfere with any flow from reshaped floor 400.

When the flow of liquids and/or light solids from reshaped floor 400 stops, the liquids and/or light solids will eventually stop flowing through drainage ring 430 and trap channels 460. In a preferred embodiment, when the flow stops, a small amount of liquids and/or light solids may be left in trap channels 460 of customized flange trap 480. This is advantageous because the remaining liquids and/or light solids left in trap channels 460 function to help prevent any sewerage gasses, such as sewerage gasses coming from drainage/sewer pipe 260, from traveling back through customized flange trap 480 and entering into the room where the present embodiment may be installed. Thus, sewerage gasses will be prevented from entering into the room where the present invention is located.

The present embodiment of the present invention may also be configured to include a flush system to flush the specialized drainage trap system of the present embodiment of the present invention, such as the system illustrated in FIGS. 4A and 4B. The flush system may operate to periodically flush some type of liquid, through the specialized drainage trap system, such as flushing water through drainage ring 430 and trap channels 460 of customized flange trap 480. The periodic flushing of liquids, such as water, detergents, bleach, toilet cleaners, sanitizers, and the like, will help to eliminate odors from the present embodiment, help to maintain the cleanliness of the specialized drainage trap system, and help to assist in keeping trap channels 460 of customized flange trap 480 moist to assist in preventing sewerage gases from backing up from drainage pipe 260 into the area where the present invention may be installed. The flush system may be configured in a variety of manners as it may be tied to the flushing mechanism on a toilet so that every time the toilet is flushed, the specialized drainage trap system will also be flushed. In an alternative embodiment, the flush system may be configured so that the flush system is on a timer so that every so often the specialized drainage trap system will be periodically flushed, regardless of when the toilet is flushed.

Figure 5A:
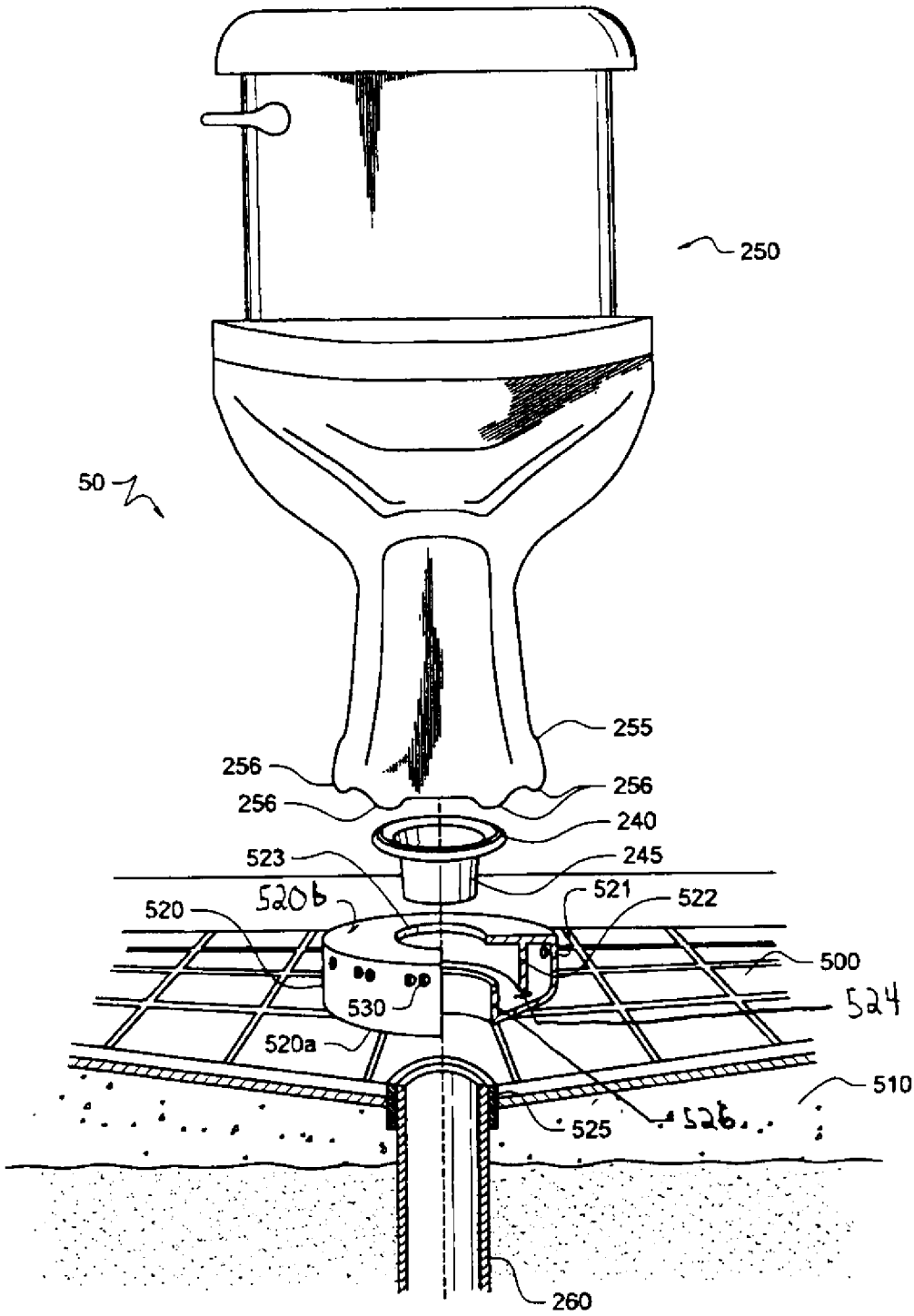
FIG. 5A is an exploded view of another embodiment of the present invention.

Another embodiment of the present invention illustrated in FIG. 5A may utilize a drainage trap system that may employ a reshaped floor or a graduated mat, a depressioned sub-floor, and a customized bowl-shaped trap wherein the bowl-shaped trap may be installed underneath the base of a toilet into the depression of the sub-floor. The customized bowl-shaped trap may include a plurality of drain holes. In such an embodiment, the toilet is configured so that feet are located at the bottom of the toilet to raise the toilet off of the floor to provide room for drainage underneath the base of the toilet. Any liquids and/or light solids that flow onto the reshaped floor or graduated mat may drain from the floor and towards the toilet so that the liquids and/or light solids will drain through the drain holes and through the trap like system of the customized bowl shaped trap and then into the sewer pipe.

Figure 5B:
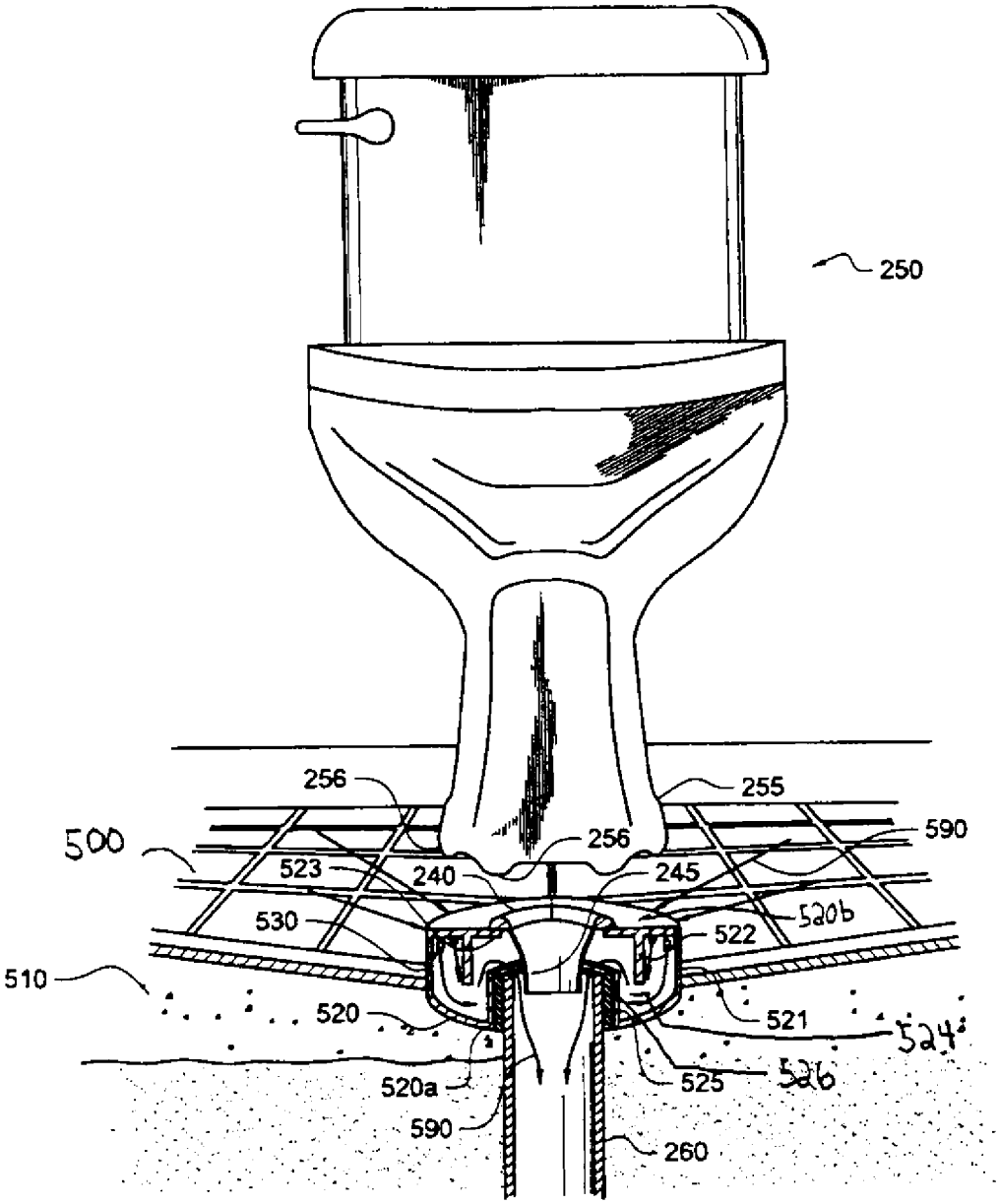
FIG. 5B is a non-exploded view of FIG. 5A.

FIG. 5A illustrates an exploded view of one embodiment of a specialized drainage trap system of the present invention and FIG. 5B is a non-exploded view of FIG. 5A that illustrates the flow of liquids and/or light solids according to an embodiment of the present invention. The specialized drainage trap system 50 may employ a specially configured toilet 250 with feet 256, reshaped floor 500, a depressioned sub-floor 510, and a customized bowl-shaped trap 520. Feet 256 may be part of toilet 250 or may be a separate component that attaches to toilet 250. FIG. 5A does not illustrate the depression in sub-floor 510, but FIG. 5B illustrates the depression, which is shown by the installation of customized bowl-shaped trap 520 down into the depression in sub-floor 510. The depression may be similar to the depressions illustrated in FIGS. 3A and 4A, except that the depression in the present embodiment will preferably be configured to accommodate customized bowl-shaped trap 520. The customized bowl shaped trap 520 may be a piece separate from toilet 250 or it may be integrated as part of toilet 250 so that toilet 250 and customized bowl-shaped trap 520 are one or more pieces that are integrated with one another. Also shown in FIG. 5A is sewer pipe 260, toilet wax ring 240 with plastic insert 245 and gasket 525.

As shown in FIG. 5A, reshaped floor 500 is configured so that it is graduated to decline towards the location of a drainage pipe in a room, such as sewer pipe 260, or base 255 of toilet 250. However, the present embodiment is not limited to this configuration as the present embodiment may utilize a graduated mat, which declines towards the location of a drainage pipe or toilet in a room, similar to mat 320 of FIGS. 3A and 3B, that is installed over a floor that has not been reshaped. Sub-floor 510 is preferably configured with a depression cut near sewer pipe 260. The depression is configured to provide enough room so that customized bowl-shaped trap 520 may be installed and/or positioned in the depression. Thus, if customized bowl-shaped trap 520 were installed into a new construction, then floor 500 and sub-floor 510 would originally be configured to account for the installation of customized bowl-shaped trap 520; and if customized bowl-shaped trap 520 were installed into a pre-existing construction, then parts of floor 500 and sub-floor 510 may be removed to provide space for customized bowl-shaped trap 520 to be installed. Thus, customized bowl-shaped trap 520 may be installed in either a new construction or pre-existing construction. In either situation, floor 500 and sub-floor 510 will be configured so that customized bowl-shaped trap 520 may be positioned in sub-floor 510.

Toilet 250 of specialized drainage trap system 50 is configured so that it includes multiple feet 256 located at the bottom of base 255 of toilet 250. Toilet feet 256 function to lift base 255 of toilet 250 above floor 500. With base 255 lifted above floor 500, there is space for liquids and/or light solids on floor 500 from an overflow condition or from a shower situation to drain underneath base 255 of toilet 250. The size of toilet feet 256 may be any number of different sizes and is not limited to any particular size. The size of feet 256 is a factor that may be used in determining how deep customized bowl-shaped trap 520 will be sunk and/or positioned in sub-floor 510. The present invention may be configured in such a manner that customized bowl-shaped trap 520 is sunk into sub-floor 510 at such a depth so that the top of outer wall member 521 is located just above floor 500 so that drainage holes 530 are located above floor 500.

Customized bowl-shaped trap 520 is preferably one piece that may include outer wall member 521, trap extension member 522, and inner wall member 526 whereby a plurality of drain holes 530 are located near the top of outer wall member 521. Customized bowl-shaped trap 520 is also configured with a hole 523 that extends from the top 520*b* of customized bowl-shaped trap 520 through to the bottom 520*a* of customized bowl-shaped trap 520 as illustrated in FIGS. 5A and 5B. However, the present invention is not limited to such configuration, as customized bowl-shaped trap 520 may be comprised of more than one piece wherein all pieces are connected to one another. Outer wall member 521 and trap extension member 522 run up and down in a circular arrangement as illustrated in FIGS. 5A and 5B.

Customized bowl-shaped trap 520 may take the shape of a bowl-like member as illustrated in FIG. 5A that is configured so that it may be installed in a depression cut into sub-floor 510 underneath base 255 of toilet 250. However the present invention is not limited to such configuration as customized bowl-shaped trap 520 of the present invention may take the form of any number of different shapes, such as a rectangular shape, a square shape, an oblong shape and the like. As customized bowl-shaped trap 520 is preferably installed underneath base 255 of toilet 250, customized bowl-shaped trap 520 is preferably sized and shaped according to the size and shape of base 255 of toilet 250. Customized bowl-shaped trap 520 is not limited to any particular type of material as it may be configured out of any number of different types of materials, such as ceramic, marble, quartz, iron, steel, chrome, plastic, porcelain, PVC, and the like.

Trap extension member 522 runs from the top 520*b* of customized bowl-shaped trap 520 towards bottom 520*a* of customized bowl shaped trap 520 and is sized to provide a gap and/or space between the end of trap extension member 522 and bottom 520*a* of customized bowl shaped trap 520. This gap is indicated by drainage trap channels 524 that are illustrated in FIGS. 5A and 5B. Drainage trap channels 524 are a space between the bottom of trap extension member 522 and the bottom 520*a* of customized bowl-shaped trap 520. Drainage trap channels 524 assist in providing the trap system functionality to specialized drainage trap system 50 as drainage trap channels 524 provide room for liquids and/or light solids flowing through drain holes 530 to eventually flow underneath trap extension member 522 and into sewer pipe 260.

Inner wall member 526 is a wall member that extends up from bottom 520*a* of customized bowl shaped trap 520 at hole 523 as illustrated in FIGS. 5A and 5B. Inner wall member 526 is configured so that it does not extend all the way up to the top 520*b* of customized bowl shaped trap 520. This limited extension of inner wall member 526 aids in providing trap system functionality to the present embodiment.

When customized bowl-shaped trap 520 is installed, customized bowl-shaped trap 520 is preferably configured so that the center of customized bowl-shaped trap 520, which may be the location of hole 523 in customized bowl shaped trap 520, is aligned with sewer pipe 260 so that the center and hole 523 of customized bowl-shaped trap 520 fits over and around sewer pipe 260. However, the present invention is not limited to this configuration as customized bowl shaped trap 520 may be configured so that hole 523 is not located in the center of customized bowl shaped trap 520. In such an embodiment, customized bowl shaped trap would be aligned with sewer pipe 260 so that hole 523 of customized bowl shaped trap 520 would fit over and around sewer pipe 260 with inner wall member 526 of customized bowl shaped trap 520 fitting around the outside of sewer pipe 260 as illustrated in FIG. 5B. In a preferred embodiment, when customized bowl shaped trap 520 is installed, it is installed so that the end of inner wall member 526 of customized bowl shaped trap 520 lines up with the end of sewer pipe 260 as illustrated in FIG. 5B.

With hole 523 of customized bowl-shaped trap 520 aligned with and sitting over and around sewer pipe 260 with inner wall member 526 of customized bowl shaped trap 520 located around the outside of sewer pipe 260, gasket 525 is used to seal sewerage pipe 260 with customized bowl-shaped trap 520 to prevent overflow from customized bowl shaped trap 520 and any sewerage gases from leaking between customized bowl-shaped trap 520 and sewer pipe 260. Gasket 525 also functions to create a secure and/or snug fit between customized bowl shaped trap 520 and sewer pipe 260 when customized bowl shaped trap 520 is installed over and around sewer pipe 260. Gasket 525 may be configured out of any number of materials, such as plastic, rubber, clay, PVC, and the like.

In the present embodiment, toilet wax ring seal 240 with plastic insert 245 is preferably installed between toilet 250 and sewer pipe 260 so that plastic insert 245 extends through hole 523 of customized bowl shaped trap 520 into sewer pipe 260. Toilet wax seal 240 with plastic insert 245 aids in directing the flow of liquids and/or light solids from toilet 250 into drainage pipe 260. Toilet wax seal 240 with plastic insert 245 is configured so that plastic insert 245 extends down through hole 523 past the end of inner wall member 526 of customized bowl shaped trap 520 and into sewer pipe 260 so that flow from toilet 250 will drain into sewer pipe 260 and will not be able to back flow into drainage trap channels 524.

In the present invention, the combination of, configuration of and positioning of drainage holes 530, drainage trap channels 524, inner wall member 526, the configuration of trap extension member 522 and specialized toilet 250 with feet 256 are such that the configuration of these components together help provide a trap system that will help to form a seal and prevent any sewerage gases from sewer pipe 260 from passing up through drainage holes 530. This seal is helpful because it prevents unpleasant odors from passing up out of sewer pipe 260 through drainage holes 530 and into the area where drainage trap system 50 may be located.

FIG. 5B illustrates the flow of liquids and/or light solids through drainage trap system 50 according to an embodiment of the present invention. As illustrated in FIG. 5B, toilet 250, toilet wax ring seal 240 and customized bowl-shaped trap 520 have been installed. Toilet 250 is shown above customized bowl-shaped trap 520 for purposes of clarity. When installed, toilet 250 may be installed to customized bowl-shaped trap 520 and/or to floor 500 and/or sub-floor 510. Prior to securing toilet 250 to customized bowl-shaped trap 520, toilet wax ring seal 240 with plastic insert 245 is preferably positioned into hole 523 of customized bowl-shaped trap 520 so that the toilet wax ring seal 240 is located between the outlet of toilet 250 and sewer pipe 260 to help to direct flow of liquids and/or light solids or other substances from toilet 250 through customized bowl-shaped trap and into sewer pipe 260.

If toilet 250 and customized bowl-shaped trap 520 are two separate pieces that are not configured as one piece, then after toilet wax ring seal 240 and insert 245 are installed, toilet 250 may be installed over toilet wax ring seal 240 and over customized bowl-shaped trap 520. When toilet 250 is installed, toilet feet 256 raise base 255 of toilet 250 off of floor 500 so that there is room for liquids and/or light solids to flow under base 255 of toilet 250 and into drainage holes 530 due to reshaped floor 500 that is preferably configured to decline towards base 255 of toilet 250.

When liquids and/or light solids from an overflow situation from a stopped up and/or clogged up toilet spill out of the toilet onto floor 500 and/or when liquids and/or light solids collect on floor 500 as a result of an elderly, handicapped, or disabled individual taking a shower outside of a tub and/or shower while sitting on a toilet, a wheel chair, bath chair, and the like and the embodiment illustrated in FIG. 5B is installed, the liquids and/or light solids on floor 500 will begin to flow towards base 255 of toilet 250 because floor 500 is configured to decline towards base 255 of toilet 250. When such situation occurs, liquids and/or light solids that spill onto reshaped floor 500 may eventually flow towards toilet 250 as illustrated by flow arrows 590 of FIG. 5B because reshaped floor 500 is graduated to decline toward toilet 250. With toilet feet 256 raising base 255 of toilet 250 above floor 500, liquids and/or light solids may flow on reshaped floor 500 towards toilet 250 and may flow under base 255 of toilet 250 and may hit the sides of customized bowl-shaped trap 520 and flow through drainage holes 530.

After flowing through drainage holes 530, any liquids and/or light solids that pass through drainage holes 530 will continue to flow down along trap extension member 522 and under trap extension member 522 through drainage trap channels 524. Any liquids and/or light solids may then flow up along inner wall member 526 of customized bowl shaped trap 520 and then into sewer pipe 260 as illustrated by flow arrows 590 of FIG. 5B. The positioning and arrangement of drainage trap system 50 as shown in FIG. 5B illustrates that plastic insert 245 of toilet wax ring seal 240 extends down from toilet 250 through customized bowl-shaped trap 520 and into sewer pipe 260 at such a distance as to not allow flow from toilet 250 to back-flow into drainage trap channels 524. Insert 245 assists in preventing said back-flow because insert 245 extends down into sewer pipe 260 at such a length as to prevent the flow from toilet 250 from back flowing through drainage trap channels 524 and to prevent the flow form toilet 250 from interfering with any flow from reshaped floor 500.

When the flow of liquids and/or light solids from reshaped floor 500 stops, the liquids and/or light solids will eventually stop flowing through drainage holes 530 and drainage trap channels 524. In a preferred embodiment, when the flow stops, a small amount of liquids and/or light solids may be left in drainage trap channels 524 of customized bowl-shaped trap 520. This is advantageous because the remaining liquids and/or light solids left in drainage trap channels 524 function to help prevent any sewerage gasses, such as sewerage gasses coming from drainage/sewer pipe 260, from traveling back through customized bowl-shaped trap 520 and entering into the room where the present embodiment may be installed. Thus, sewerage gasses will be prevented from entering into the room where the present invention is located.

The present embodiment of the present invention may also be configured to include a flush system to flush the specialized drainage trap system of the present embodiment of the present invention, such as the system illustrated in FIGS. 5A and 5B. The flush system may operate to periodically flush some type of liquid, through the specialized drainage trap system, such as flushing water through drainage holes 530 and drainage trap channels 524 of customized bowl-shaped trap 520. The periodic flushing of liquids, such as water, detergents, bleach, toilet cleaners, sanitizers, and the like, will help to eliminate odors from the present embodiment, help to maintain the cleanliness of the specialized drainage trap system, and help to assist in keeping drainage trap channels 524 of customized bowl-shaped trap 520 moist to assist in preventing sewerage gases from backing up from drainage pipe 260 into the area where the present invention may be installed. The flush system may be configured in a variety of manners as it may be tied to the flushing mechanism on a toilet so that every time the toilet is flushed, the specialized drainage trap system will also be flushed. In an alternative embodiment, the flush system may be configured so that the flush system is on a timer so that every so often the specialized drainage trap system will be periodically flushed, regardless of when the toilet is flushed.

The embodiments of the present invention may also contain a filter mechanism that can be installed where the liquids and/or light solids drain into the specialized drainage trap systems. The filter may be used to filter out larger solids and the like in order to assist in preventing blockages to the specialized drainage trap systems. The filter may comprise any number of materials, such as rubber, plastic, PVC, steel, screen like material, and the like.

Figure 6:
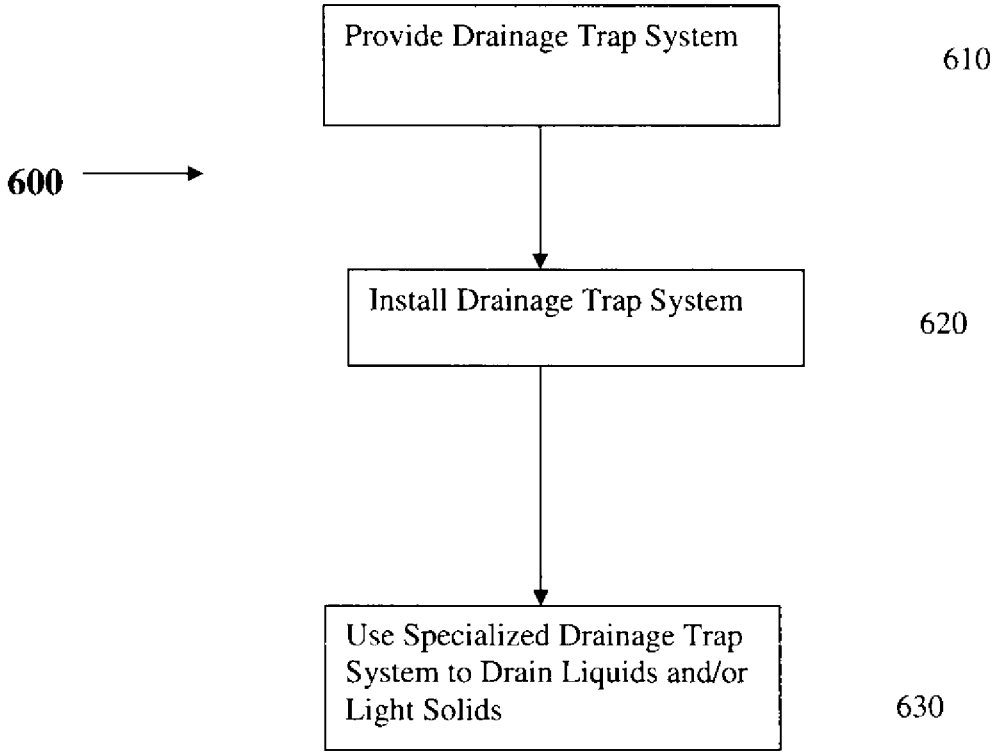
FIG. 6 is a flowchart representing one method for draining liquids and/or light solids according to one embodiment of the present invention.

FIG. 6 illustrates a flowchart representing one method for draining liquids and/or light solids. Flow 600 represents one method in which liquids and/or light solids may be drained according to one embodiment of the present invention. In block 610, a specialized drainage trap system is provided. The specialized drainage trap system may comprise embodiment 20 illustrated in FIGS. 2A and 2B, embodiment 30 illustrated in FIGS. 3A and 3B, embodiment 40 illustrated in FIGS. 4A and 4B, embodiment 5 illustrated in FIGS. 5A and 5B or other alternative embodiments. After the specialized drainage trap system is provided in block 610, flow 600 proceeds to block 620 where the specialized drainage trap system is installed. In installing the specialized drainage trap system, a toilet is removed and the specialized drainage trap system is installed, and then the toilet is reinstalled to function with the specialized drainage trap system. For example, if embodiment 20 is used in a pre-existing bathroom, then toilet 250 may be removed, the floor may be reshaped to decline toward the base of the toilet or a specialized mat may be installed that declines towards the base of the toilet, inner chamber flange apparatus 220 and toilet flange 230 may be installed with the remaining components of embodiment 20, and then toilet 250 is reinstalled so that it is raised above the floor to provide for drainage underneath the base of the toilet.

After block 620, flow 600 may proceed to block 630 where liquids and/or light solids are drained through the specialized drainage trap system. In putting the specialized drainage trap system to use, an individual, such as an elderly, a handicapped, and/or a disabled individual may take a shower while remaining in a wheel chair and/or by sitting on the reinstalled toilet without having to get into a tub and/or shower. In taking a shower, the individual may utilize a shower hose connected to a water source and proceed to use the shower hose to complete the showering process while sitting on the reinstalled toilet that is installed with the specialized drainage trap system. During the course of the shower, any liquids and/or light solids falling to the floor, will drain towards the reinstalled toilet and drain underneath the toilet through the specialized drainage trap system. The method described in FIG. 6 is just one method of draining liquids and/or light solids according to one embodiment of the present invention. The present invention is not limited to the method described in FIG. 6.

Figure 7:
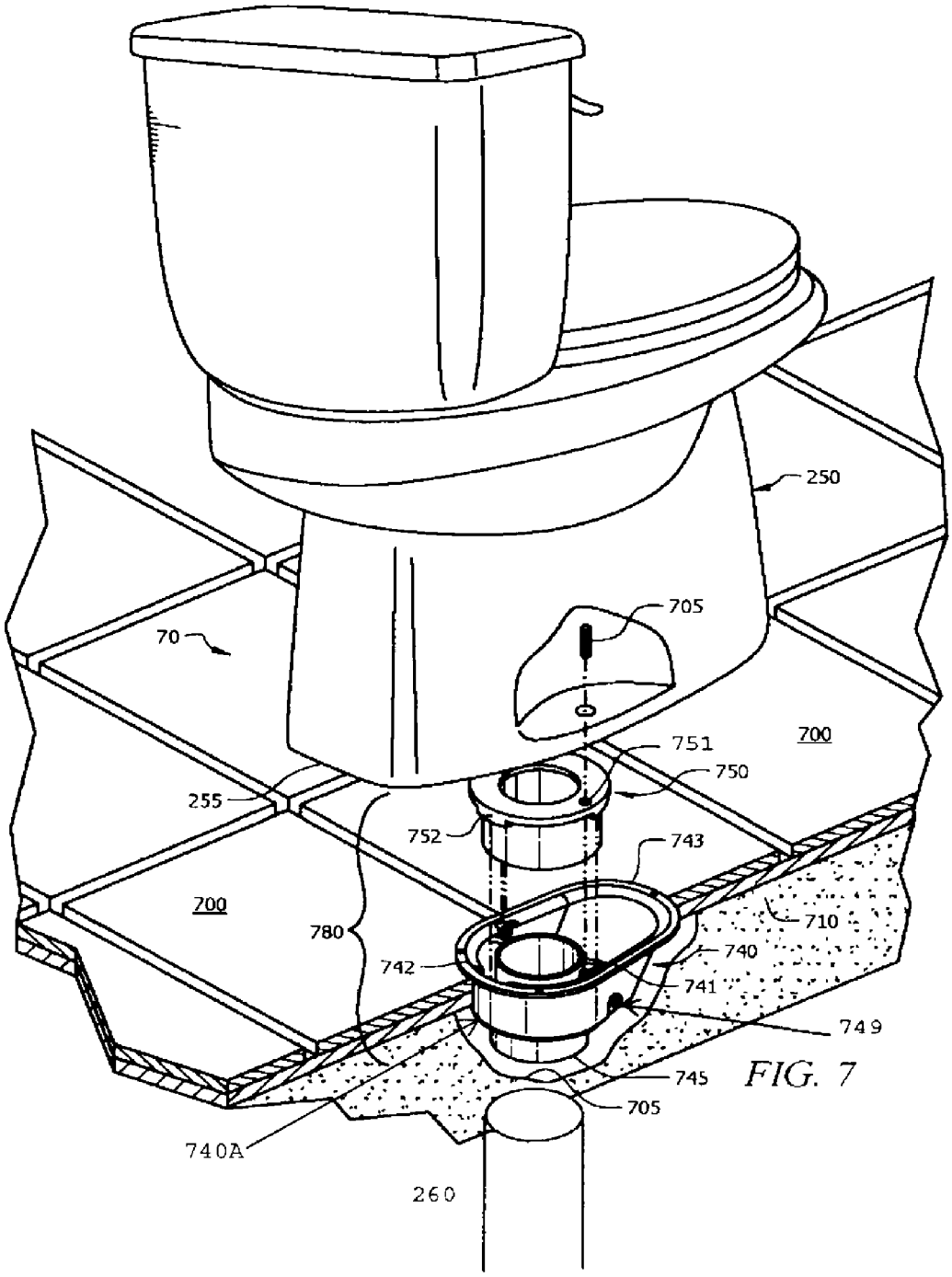
FIG. 7 is an exploded view of one embodiment of the present invention.

FIG. 7 illustrates an exploded view of one embodiment of a specialized drainage trap system of the present invention. The specialized drainage trap system 70 may employ a reshaped floor 700, a depressioned sub-floor 710, and a customized flange trap 780. FIGS. 7-12 illustrate one configuration of customized flange trap 780 and FIGS. 13-18 illustrate another configuration of a customized flange trap 780. However, for the sake of clarity the customized flange trap in FIGS. 13-18 will be labeled 880 instead of 780.

Both configurations of the customized flange trap (780 in FIGS. 7-12 and 880 in FIGS. 13-8) include a flange piece 750 and a base 740. The differences between the two configurations, as illustrated in the drawings and discussed herein, concern whether or not the sewer pipe 260 will extend up into base 740 to help create trap like functionality. In the embodiment illustrated in FIGS. 7-12, customized flange trap 780 includes base 740 that is configured to include a pipe member 745 to help provide trap like functionality. In the embodiment illustrated in FIGS. 13-18, customized flange trap 880 includes base 740 that is configured with a different configuration of a pipe member and uses sewer pipe 260 to help provide trap like functionality. Thus, the key difference between two embodiments of the customized flange trap is that one configuration (FIGS. 7-12) includes pipe member 745 that extends up into base 740 and one configuration (FIGS. 13-18) includes a pipe member 845 that does not extend up into base 740.

Figure 8:
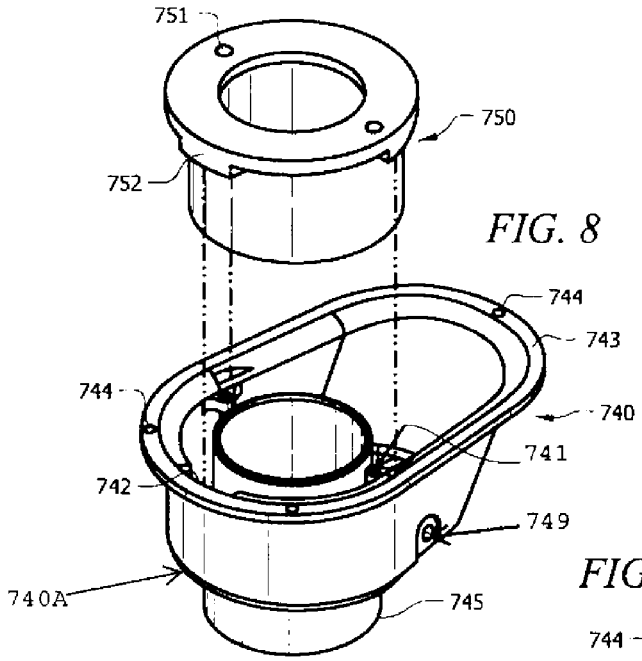
FIGS. 8, 9, and 10 are alternative views of the embodiment illustrated in FIG. 7.
Figure 9:
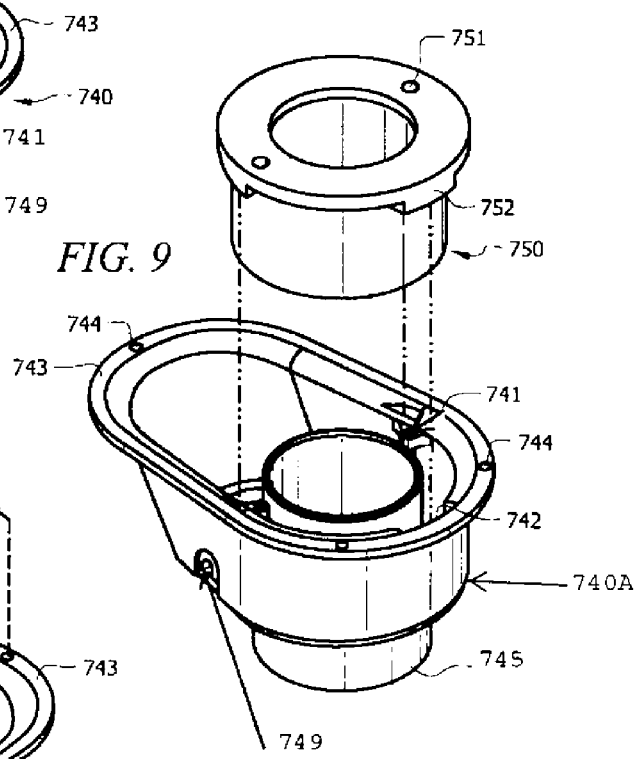

As illustrated in FIG. 7, customized flange trap 780 includes a flange piece 750 with a lip, and a base 740 having a bottom 740A and a lip 743 and a pipe member 745 that extends upward toward lip 743 and downward below bottom 740A whereby the flange piece 750, base 740 with pipe member 745 assist in forming a trap like system. As illustrated in FIGS. 7, 8, and 9, in one embodiment of the present invention, pipe member 745 extends down below the bottom 740A of base member 740 and extends up into base 740 up towards lip 743 of base 740. This configuration of pipe member 745 assists in providing trap like functionality to customized flange trap 780.

Reshaped floor 700 may be configured so that the floor declines toward base 255 of toilet 250. However, the present embodiment is not limited to this configuration as the present embodiment may utilize a graduated mat, similar to mat 320 of FIGS. 3A and 3B, that is installed over a floor that has not been reshaped. When customized flange trap 780 is utilized, toilet 250 will be installed to customized flange trap 780 at an elevated position so that there is space for liquids and/or light solids, such as those from an overflow situation, to flow underneath base 255 of toilet 250 and into customized flange trap 780 and eventually down sewer pipe 260. The size of the elevated position that toilet 250 is installed over customized flange trap 780 is not limited to any specific size and may be configured so that it is any number of sizes, such a 1/16 of an inch, 1/8 of an inch, 3/16 of an inch, 1/4 of an inch, 3/8 of an inch, 1/2 of an inch, and the like. The illustration of the sizes listed is merely an illustration and is not a limitation of the present invention. This elevated mounting of toilet 250 provides room for liquids and/or light solids to flow into trap 780 and eventually drain through to sewer pipe 260 as further explained below.

Sub-floor 710 is preferably configured with a depression 705 cut into sub-floor 710 near sewer pipe 260, which provides drainage for toilet 250. The depression 705 is configured to provide enough room so that base 740 may be installed and/or positioned in the depression 705 cut into sub-floor 710. Thus, if customized flange trap 780 were installed into a new construction, then floor 700 and sub-floor 710 would be originally configured to account for the installation of base 740; and if customized flange trap 780 were installed into a pre-existing construction, then parts of floor 700 and sub-floor 710 may be removed or reconfigured to provide space for base 740 to be installed. Thus, customized flange trap 780 may be installed in either a new construction or pre-existing construction. In either situation, floor 700 and/or sub-floor 710 may be configured so that base 740 may be positioned below floor 700 and down into sub-floor 710.

Customized flange trap 780 is preferably configured to include a means to secure toilet 250 to customized flange trap 780. As illustrated in FIGS. 7, 8, and 9 flange piece 750 and base 740 are configured with holes, 751 and 741, respectively, which align with one another when customized flange trap 780 is installed. Holes 751 are located in the lip of flange piece 750. As illustrated in FIG. 7 a fastening mechanism 705, such as a bolt, screw, nail, and the like extend down through the holes in toilet base 255 and then extend down through holes 751 of flange piece 750 and then down into holes 741 of base 740. Holes 741 are preferably configured with threads so that a fastening mechanism 705, such as bolts, can screw into holes 741 of base 740 to secure toilet 250 when toilet 250 is installed. Holes 741 may also be configured as a receiving member that receives a fastening mechanism, such as a bolt, screw, or the like, that has a bottom so that a fastening mechanism, such as a bolt, screwed into holes 741 can only screw down to said bottom. The present invention is not limited to the use of any particular fastening mechanism as the present invention may be configured so that other fastening means, such as a nail, screw, or the like may be inserted through holes 751 and 741 to assist in fastening and/or securing toilet 250 to customized flange trap 780. The use of a fastening mechanism 705 is also important to help secure flange piece 750 in position with base 740 to provide trap like functionality as described herein.

Figure 11:
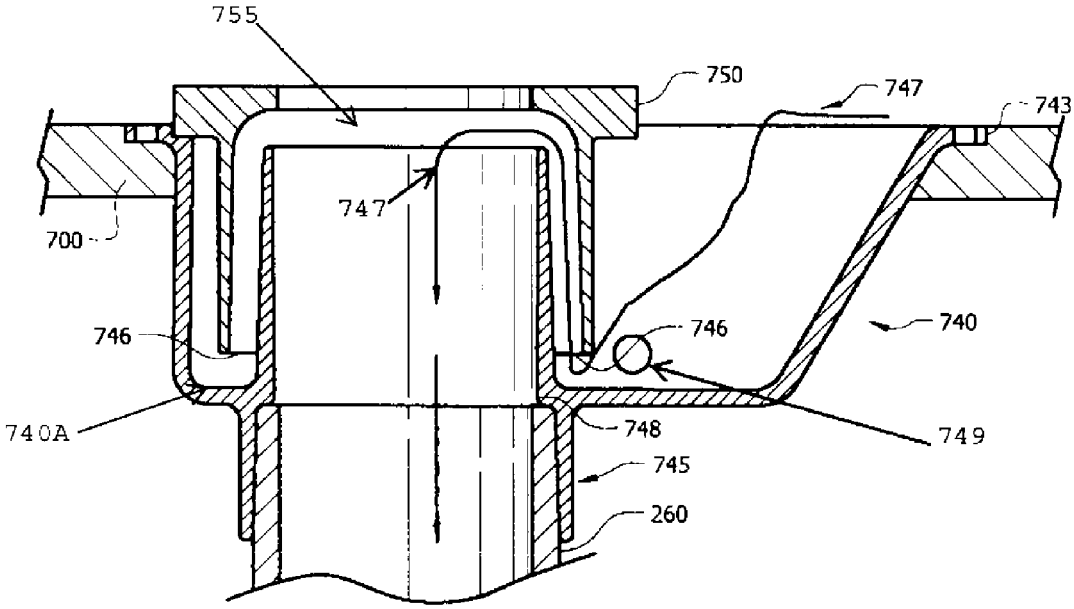
FIGS. 11 and 12 are cut away views of the embodiment illustrated in FIG. 7.

Base 740 may take the shape of an elongated bowl-like member that extends forward as illustrated in FIG. 7 that is configured with a bottom 740A so that it may be installed in the depression 705 cut into sub-floor 710. However base 740 of the present invention is not limited to the configuration of an elongated bowl like member as illustrated in FIG. 7, as base 740 may take the form of any number of different shapes and sizes. When base 740 is installed in said depression 705, base 740 is preferably configured so that pipe member 745 of base 740 is aligned with sewer pipe 260. Base 740 may also be configured so that when pipe member 745 is aligned with sewer pipe 260, pipe member 745 will fit over sewer pipe 260 as illustrated in FIG. 11. However, other embodiments of the present invention may be configured so that pipe member 745 is configured to fit inside of sewer pipe 260.

Base 740 is not limited to any particular type of material as it may be configured out of any number of different types of materials, such as ceramic, plastic, PVC, marble, iron, steel, and the like. While base 740 is illustrated in FIG. 7 as one piece, the present invention is not limited to such configuration. In alternative embodiments, base 740 may comprise multiple pieces that connect together to form base 740. For example base 740 may comprise a front half and a back half that connect to one another to form one base 740.

Base 740 of customized flange trap 780 also includes pipe member 745 that is preferably located in the center of the back end of base 740 and it extends up toward lip 743 and down below bottom 740A. However, the present invention is not limited to this configuration, as pipe member 745 may be configured so that it is not located in the center of the back end of base 740. When base 740 is installed in depression 705 of sub-floor 710, base 740 will be aligned with sewer pipe 260 so that pipe member 745 will align with sewer pipe 260 so that the bottom of pipe member 745 will extend down over and around sewer pipe 260 as illustrated in FIG. 11. With the bottom of pipe member 745 extended down over and around sewer pipe 260, any drainage flowing through toilet 250 will eventually flow down through base 740 through pipe member 745 and down into sewer pipe 260. The present invention may also be configured so that pipe member 745 extends down into sewer pipe 260 instead of extending down and over sewer pipe 260. In such an embodiment, flow from toilet 250 would still flow down through base 740 and through pipe member 745 into sewer pipe 260.

Customized flange trap 780 may be configured so that pipe member 745 of base 740 is preferably configured in such an embodiment so that pipe member 745 fits very tight around sewer pipe 260 so that there would be no leakage where pipe member 745 fits around the outside of sewer pipe 260.

An embodiment of the present invention may also be configured so that base 740 of customized flange trap 780 also includes flush holes 749 as illustrated in FIGS. 7, 8, 9, 10, 11, 13, 14, 15, 16, and 18. Flush holes 749 provide an opening and/or entry point into base 740 so that a flush system, as discussed herein, can actually flush the specialized drainage trap system of the present invention for various reasons as discussed herein.

As illustrated in FIGS. 7, 8, and 9, flange piece 750 may be configured with teeth 752 that are used to secure flange piece 750 to base 740, in addition to fastening mechanism 705, by teeth 752 extending down into grooves 742 of base 740. The teeth—groove components (752 and 742) of flange piece 750 and base 740 align with one another so that when flange piece 750 is installed down into base 740, flange piece 750 can not rotate because the teeth—groove combination of teeth 752 and grooves 742 keep flange piece 750 from rotating in base 740. The teeth—groove combination also assists in positioning flange piece 750 above pipe member 745 to assist in providing trap like functionality as this teeth—groove combination may be configured so that this combination keeps flange piece 750 above pipe member 745 so that a space exists between the top of pipe member 745 and the lip of flange piece 750. Customized flange trap 780 may be configured to include multiple grooves 742 in base 740 that will align with multiple teeth 752 in flange piece 750 in order to provide additional locking mechanisms to keep flange piece 750 from rotating or moving around base 740 after flange piece 750 has been installed in base 740.

Pipe member 745 is not limited to any particular type of material as it may be configured out of any number of different types of materials, such as ceramic, marble, iron, steel, PVC, plastic, chrome, aluminum, and the like.

The present invention may be configured in such a manner that base 740 is sunk into sub-floor 710 at such a depth so that outer lip 743 of base 740 sits underneath reshaped floor 700. However, the present invention is not limited to this configuration as in an alternative embodiment, base 740 may also be installed in the depression 705 of sub-floor 710 at such a depth so that outer lip 743 of base 740 sits level and/or even with floor 700 while the remaining portions of base 740 may be underneath floor 700 in the depression 705 of sub-floor 710 as illustrated in FIG. 11.

Figure 10:
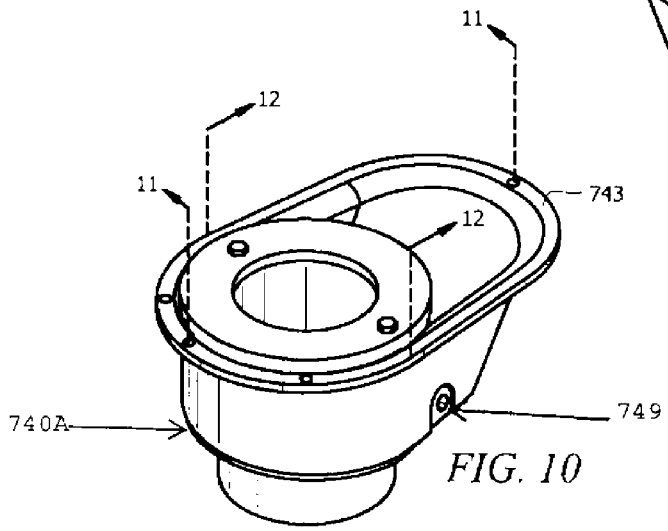

FIGS. 8, 9, and 10 illustrate alternative views of the embodiment illustrated in FIG. 7. FIGS. 8 and 9 clearly illustrate bolt holes 751 and 741 used to secure toilet 250 to customized flange trap 780. In addition, FIGS. 8 and 9 illustrate grooves 742 in base 740 that will align with multiple teeth 752 in flange piece 750. FIGS. 8 and 9 further illustrate holes 744 in outer lip 743 of base 740. Holes 744 may be utilized to assist in securing base 740 to floor 700 and/or sub-floor 710. In one embodiment, fastening devices, such as screws, may be inserted through holes 744 to assist in securing and/or fastening base 740 to floor 700 and/or sub-floor 710. The present invention is not limited to including holes 744 as it is an alternative means to assist in securing and/or fastening base 740 to floor 700 and/or sub-floor 710.

Figure 12:
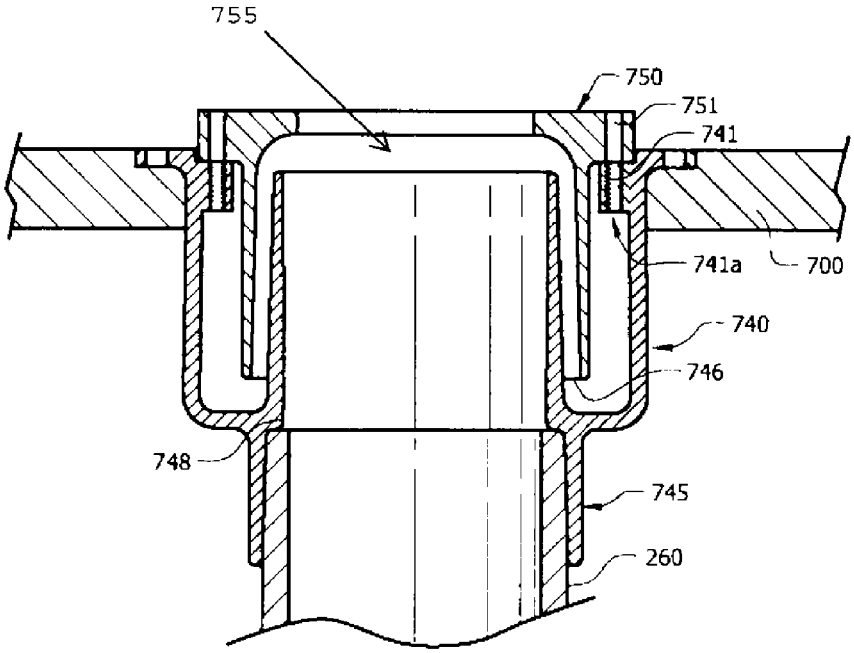

FIG. 10 illustrates customized flange trap 780 when flange piece 750 is installed down over pipe member 745 of base 740. Numbers 11 and 12 of FIG. 10 illustrate the location of the cross sectional views that are illustrated in FIGS. 11 and 12, respectively. FIG. 11 illustrates a cross sectional view of customized flange trap 780 installed in floor 700. Toilet 250 is not illustrated to provide a clear view of customized flange trap 780. As illustrated in FIG. 11, when customized flange trap 780 in installed, base 740 is positioned in such a manner that pipe member 745 fits down over and around sewer pipe 260 so that drainage from toilet 250 can pass through toilet 250 and down pipe member 745 into sewer pipe 260.

The cross sectional view of FIG. 11 assists in illustrating the flow of liquids and/or light solids according to an embodiment of the present invention. In an overflow situation involving a toilet, a toilet will usually become stopped up and/or clogged so that liquids and/or light solids in the toilet back up and may eventually spill out of the toilet and onto the surrounding area, such as floor 700. Liquids and/or light solids may also spill onto the surrounding area from an overfilled bathtub or a clogged shower. When an overflow situation occurs from a toilet, bathtub, shower, or the like, liquids and/or light solids that may spill onto reshaped floor 700 will eventually flow toward base 255 of toilet 250 because floor 700 is reshaped to decline towards toilet base 255. Because toilet 250 is installed at an elevated position above floor 700, there is room for liquids and/or light solids to flow underneath base 255 of toilet 250 through the elevated space. Thus, the liquids and/or light solids will flow underneath base 255 of toilet 250 and through the elevated space and into specialized drainage trap system 780 of the present invention.

As illustrated in FIG. 11, when customized flange trap 780 is installed, base 740 is installed such that pipe member 745 will fit down over sewer pipe 260 and will extend down over sewer pipe 260 until sewer pipe 260 hits stop lip 748 of pipe member 745. Stop lip 748 functions as a stop point to signal when pipe member 745 of base member 740 has been installed far enough over sewer pipe 260.

When customized flange trap 780 is installed, flange piece 750 is configured so that it is installed at an elevated position above the top of pipe member 745 so that there is a space 755 between the top of pipe member 745 and flange piece 750 that allows for drainage to flow up over pipe member 745 and eventually flow into sewer pipe 260. Flange piece 750 is also configured so that it is larger than pipe member 745 so that it fits down over pipe member 745 so that there is a space 746 between the outer wall of pipe member 745 and the wall of flange piece 750. This space 746 assists in providing trap like functionality as it provides room for any liquids and/or light solids flowing from reshaped floor 700 into base 740 to eventually flow into sewer pipe 260. Because toilet 250 is installed at an elevated position above floor 700, any liquids and/or light solids on floor 700 can flow on the reshaped floor 700 towards toilet 250 and eventually into base 740 and then up through space 746 and over the top of pipe member 745 through space 755 and down into pipe member 745 and eventually into sewer pipe 260.

For example, when an overflow situation from a stopped up and/or clogged up toilet, sink, bathtub, and/or the like occurs, liquids and/or light solids may back up and eventually spill out of the toilet, tub, sink and the like and onto the surrounding area, such as reshaped floor 700. Likewise, when customized flange trap 780 is installed, an individual may take a shower, while sitting on a toilet, a wheel chair, bath chair, and the like without getting into a tub and/or shower; in such a situation, liquids and/or light solids will likely gather on reshaped floor 700. When such an overflow and/or shower situation occurs, liquids and/or light solids that spill onto reshaped floor 700 may eventually flow towards toilet 250 and base 740 as illustrated by flow arrows 747 of FIG. 11 because reshaped floor 700 is graduated to decline toward toilet 250. Likewise, if floor 700 was not reshaped, and a graduated mat was installed over floor 700, the liquids and/or light solids on the graduated mat would also eventually flow towards toilet 250. At toilet 250, any liquids and/or light solids will flow underneath base 255 of toilet 250 into base 740. The flow of liquids and/or light solids will flow into base 740 and then flow through space 746 upwards and eventually flow over pipe member 745 through space 755 and through pipe member 745 eventually flowing into sewer pipe 260 as illustrated by flow arrows 747. The flow of liquids and/or light solids through customized flange trap 780 will not interfere with the normal flow through toilet 250 into drainage pipe 260 from the normal operation of the toilet.

When the flow of liquids and/or light solids from floor 700 stops, the liquids and/or light solids will eventually stop flowing into base 740 and through space 746. In a preferred embodiment, when the flow stops, a small amount of liquids and/or light solids may be left in base 740 near space 746. This is advantageous because the remaining liquids and/or light solids left in base 740 function to help prevent any sewerage gasses, such as sewerage gasses coming from drainage/sewer pipe 260, from traveling back through base 740 and entering into the room where the present embodiment may be installed. Thus, sewerage gasses will be prevented from entering into the room where the present invention is located.

The cross sectional view of FIG. 12 clearly illustrates holes 751 and 741 of flange piece 750 and base 740, respectively. As illustrated in FIG. 12, a bolt or other fastening mechanism may be installed through flange piece 750 via holes 751 and screw into holes 741 of base 740 because holes 741 are preferable configured with threads to receive a bolt or other fastening mechanism positioned into holes 741. The threads are advantageous as they provide a means to secure a bolt or other fastening mechanism to base 741. In a preferred embodiment, holes 741 are also configured with a stop point 741A that provides a stopping position for any bolt or other fastening mechanism that may be positioned into holes 741.

Figure 13:
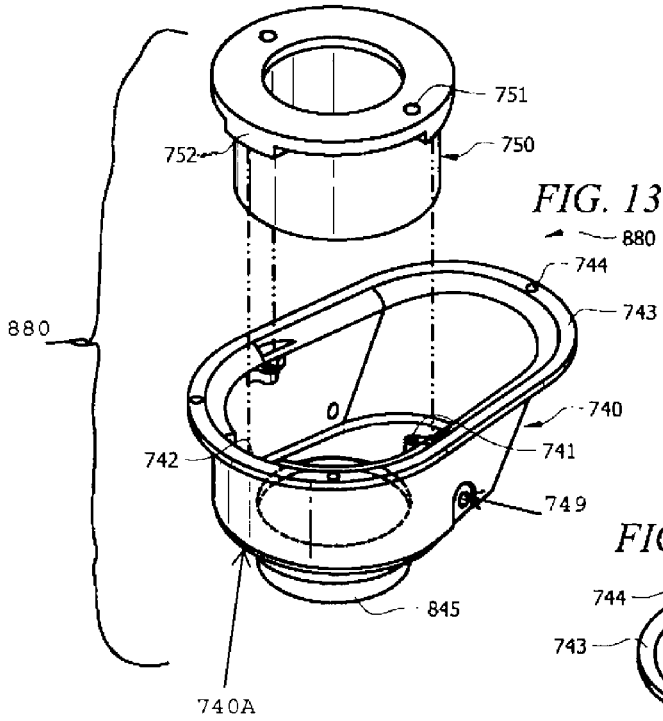
FIGS. 13, 14, and 15 are views of an embodiment of the present invention.
Figure 14:
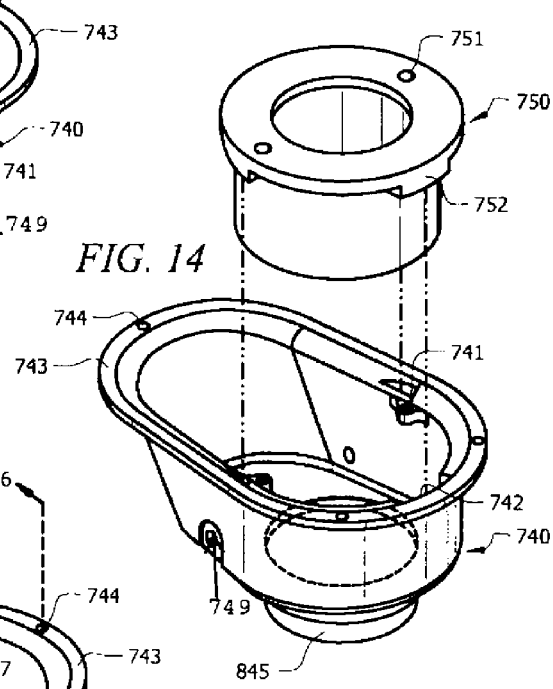

FIGS. 13 through 18 illustrate another embodiment of a customized flange trap, customized flange trap 880. As illustrated in FIGS. 13 and 14, this embodiment of a customized flange trap 880 includes base 740 with pipe member 845, flange piece 750, holes 741 and 751, teeth 752 and grooves 742. Holes 741 and 751 and teeth 752 and grooves 742 operate in the same manner as described for customized flange trap 780. When utilizing customized flange trap 880, base 740 may be installed into some type of depression cut into the sub-floor and in a preferred embodiment, the floor would be reshaped to decline towards base 740. Similar to use of customized flange trap 780, toilet 250 will be installed at an elevated position above the floor and above customized flange trap 880 to allow space for liquids and/or light solids to flow on the reshaped floor under toilet 250 and into base 740 of customized flange trap 880.

Figure 15:
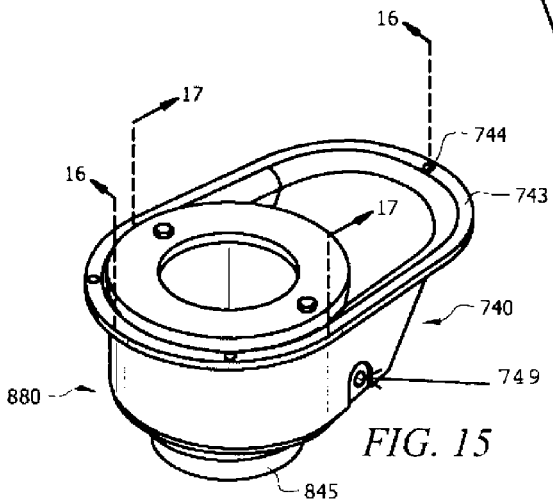
Figure 16:
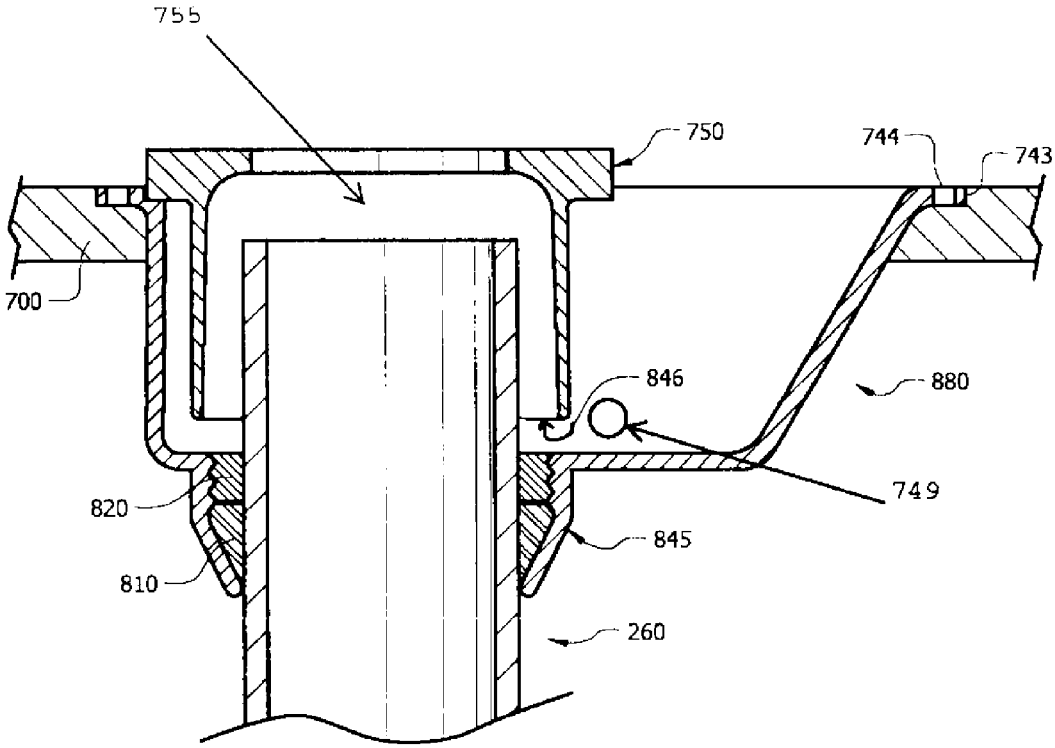
FIGS. 16 and 17 are cut away views of the embodiment illustrated in FIGS. 13, 14, and 15.
Figure 17:
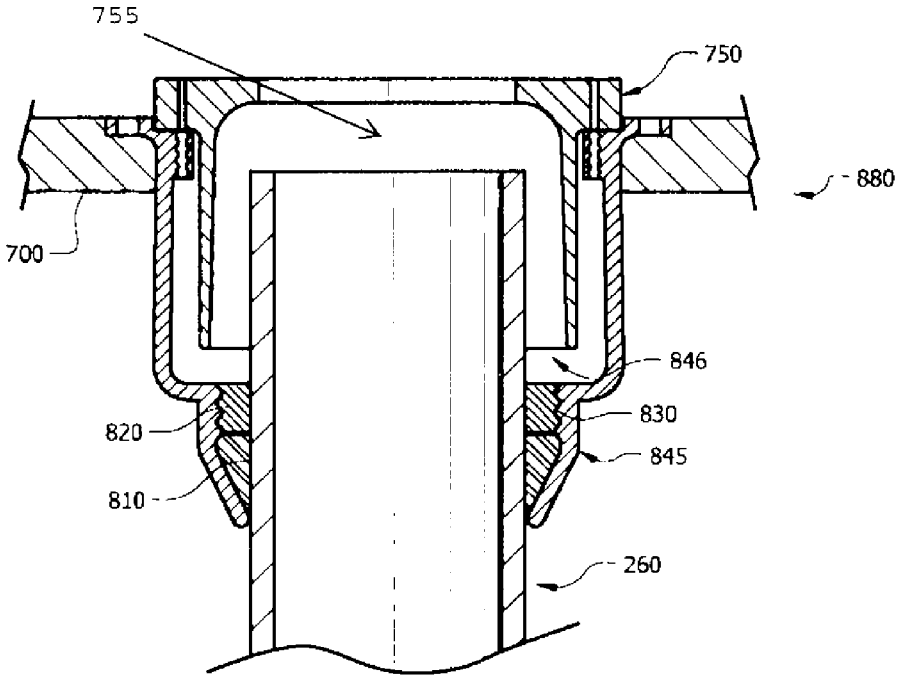

One difference between customized flange trap 880 in FIGS. 13 through 18 and the customized flange trap 780 in FIGS. 7 through 12 is in the configuration of the pipe member. As illustrated in FIGS. 7 through 12, pipe member 745 of base 740 of customized flange trap 780 extends up into base 740 and down below bottom 740A of base 740 to assist in providing trap like functionality. However in FIGS. 13 through 18, pipe member 845 does not extend up into base 740 but only extends down below bottom 740A of base 740. In this embodiment, customized flange trap 880 utilizes a sewer pipe, such as sewer pipe 260, as illustrated in FIGS. 16 and 17, to assist in providing trap like functionality.

FIGS. 16 and 17 provide cross sectional views of customized flange trap 880 that correspond to numbers 16 and 17 of FIG. 15. The cross sectional view of FIG. 16 illustrates pipe member 845 and how it only extends down below bottom 740A of base 740 and not into base 740. Also illustrated is how sewer pipe 260 extends up into base member 740 to assist in providing trap like functionality. When customized flange trap 880 is installed, base member 740 is installed into a depression in the floor/sub-floor and over sewer pipe 260 with sewer pipe 260 extending up and into base 740. Flange piece 750 is then installed such that it extends into base 740 and over sewer pipe 260. Flange piece 750 is configured so that it is larger than sewer pipe 260 so that there is a space 846 between the outer wall of sewer pipe 260 and the walls of flange piece 750. Space 846 is important as it allows liquids and/or light solids draining into base 740 to eventually flow into sewer pipe 260. In addition, flange piece 750 is configured so that it is installed at an elevated position above the top of sewer pipe 260 that extends up into base 740 as illustrated in FIG. 16 so that there is a space 755 between the top of sewer pipe 260 and flange piece 750 that allows for drainage to flow up over sewer pipe 260 and eventually flow into sewer pipe 260.

Also illustrated in FIGS. 16 and 17 is gasket 810 and threaded ring 820. Gasket 810 and threaded ring 820 operate to assist in securing base 740 to sewer pipe 260. In addition, gasket 810 and threaded ring 820 provide a seal that prevents any liquids and/or light solids that drain into base 740 from draining out of base 740 at the bottom near pipe member 845. Thus, as liquids and/or light solids drain into base 740 the only path these liquids and light solids can take to eventually drain into sewer pipe 260 is by flowing under flange piece 750 through space 846 and then up and through space 755 and over into sewer pipe 260.

In a preferred embodiment of customized flange trap 880, pipe member 845 may be configured to include threaded portion 830, illustrated in FIG. 17, to receive threaded ring 820. When customized flange trap 880 in installed, gasket 810 may be slid down over the outside of sewer pipe 260 with base 740 installed over sewer pipe 260 with pipe member 845 supplying some force or compression onto gasket 810 such that a tight seal is provided between pipe member 845 and sewer pipe 260. After base 740 is installed over sewer pipe 260, threaded ring 820 may then be installed around the outside of sewer pipe 260 on top of gasket 810 with ring 820 threaded into threaded portion 830 of pipe member 845. As threaded ring 820 is threaded and tightened into threaded portion 830 of pipe member 845, extra force and/or compression is applied to gasket 810 forming a very strong and tight seal between gasket 810 and sewer pipe 260 such that no liquids and/or light solids could pass between sewer pipe 260 and gasket 810. Threaded ring 820 also provides another barrier for liquids and/or light solids that may drain into base 740 because no liquids and/or light solids can pass through threaded ring 820. Ring 820 is also sized so that it fits securely in threaded portion 830 and around sewer pipe 260 such that there is no space for liquids and/or light solids to pass between ring 820 and sewer pipe 260. Thus, threaded ring 820 and gasket 810 form a barrier preventing any liquids and/or light solids that may be in base 740 from leaking out of pipe member 845 down the outside of sewer pipe 260.

Figure 18:
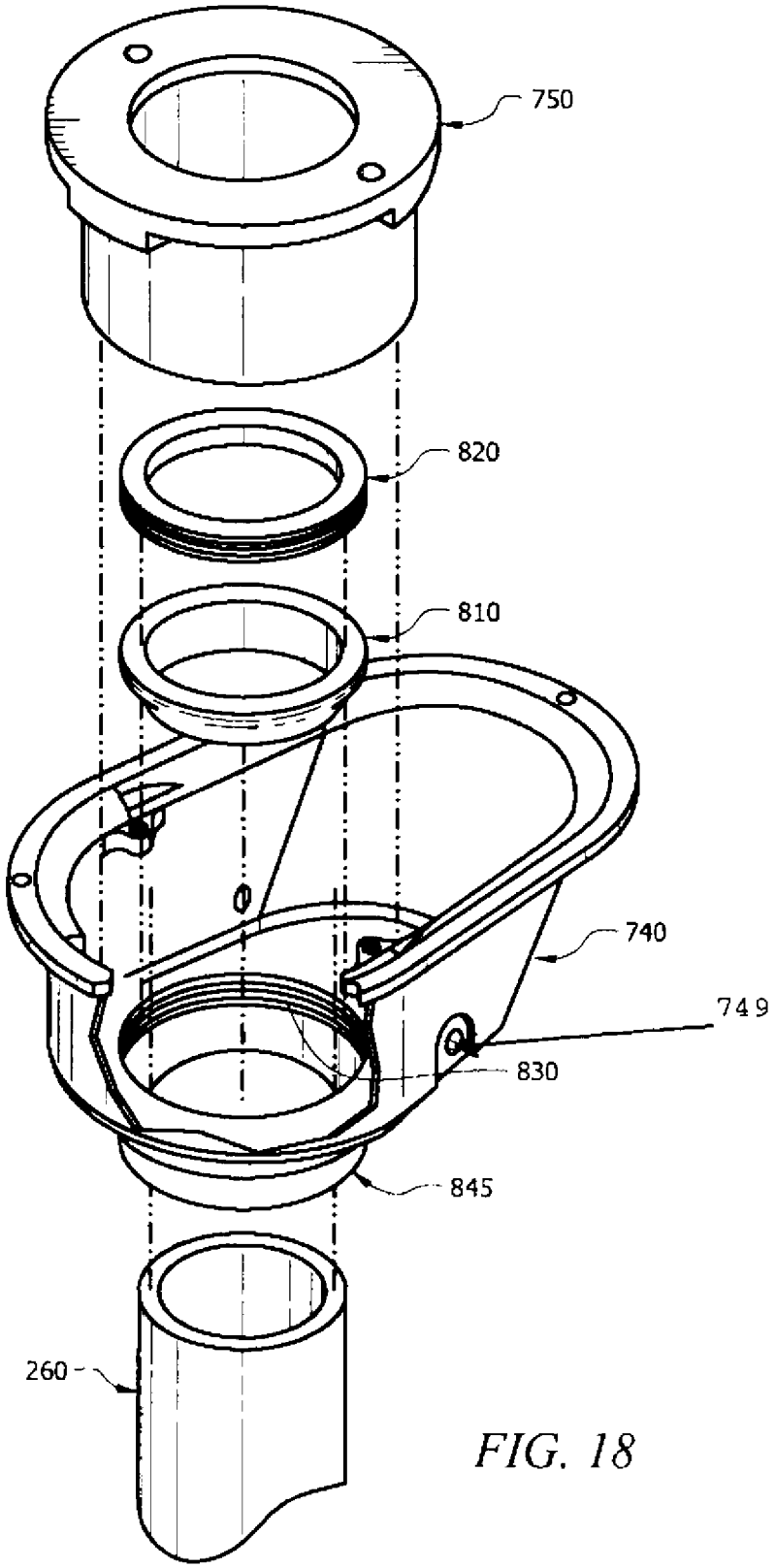
FIG. 18 is an exploded view of the embodiment illustrated in FIGS. 13, 14, and 15.

FIG. 18 illustrates an exploded view of customized flange trap 880. This exploded view illustrates how base 740 is installed over sewer pipe 260 with pipe member 845 extending out below base 740 and going around the outside of sewer pipe 260. Also illustrated is gasket 810 and threaded ring 820 with flange piece 750 installing over sewer pipe 260, after sewer pipe 260 has extended up into base 740.

The embodiments of the present invention of FIGS. 7 through 18 may also be configured to include a flush system to flush the specialized drainage trap system of the present invention. In such an embodiment, a flush system may include some type of piping, tubing, and/or hose that will carry any type of flushing liquid/chemical into base 740 of the trap system with the tubing, piping, and/or hose extending through flush holes 749. The invention may also be configured so that some type of fitting is installed at flush hole 749 so that any tubing, piping, and/or hose that may be used in a flushing system would simply connect to the fitting that may be installed at flush hole 749; and when in operation, any liquids or other matter used in such a flushing system would discharge into base 740 through flush holes 749.

The flush system may operate to periodically flush some type of liquid, through the specialized drainage trap system, such as flushing water through base 740. The periodic flushing of liquids, such as water, detergents, bleach, toilet cleaners, sanitizers, and the like will help to eliminate and odors that may exist in the present embodiment, help to maintain the cleanliness of the specialized drainage trap system, and help to assist in keeping base 740 moist to assist in preventing sewerage gases from backing up from drainage pipe 260 into the area where the present invention may be installed. The flush system may be configured in a variety of manners as it may be tied to the flushing mechanism on a toilet so that every time the toilet is flushed, the specialized drainage trap system will also be flushed. In an alternative embodiment, the flush system may be configured so that the flush system is on a timer so that every so often the specialized drainage trap system will be periodically flushed, regardless of when the toilet is flushed.

Figure 19:
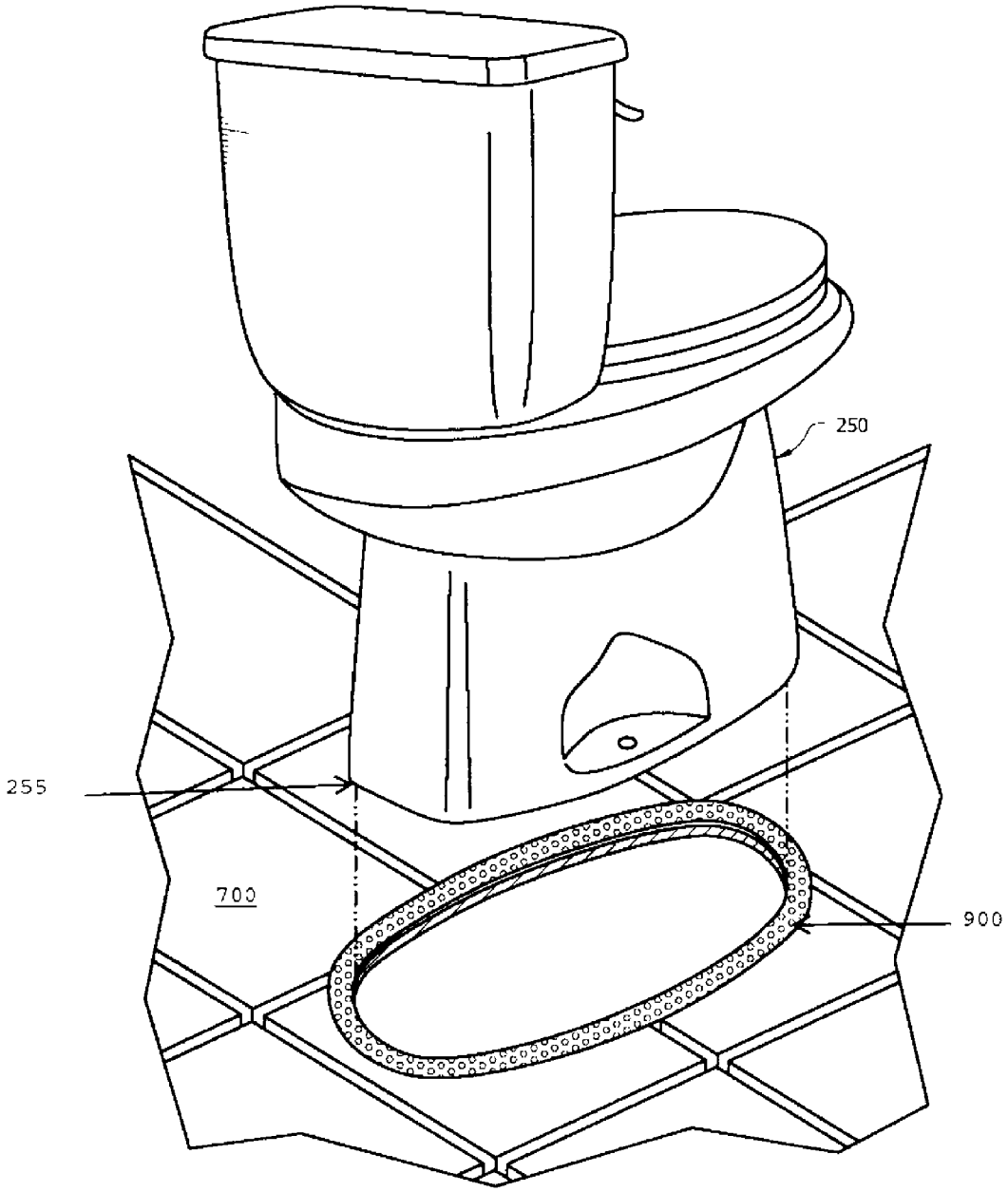
FIG. 19 is an illustration of the use of drain covers/screens with the present invention.

FIG. 19 illustrates an embodiment of the present invention that may also be configured so that the embodiments illustrated in FIGS. 7 through 18 may be configured to include a drain cover, strainer, and/or screen 900 that may be installed in a reshaped floor, such as floor 700. Such a drain cover/strainer and/or screen 900 may be installed near the toilet base 255 so that any liquids and/or light solids that would be draining on reshaped floor 700 towards toilet base 255 would eventually pass through the drain cover/strainer and/or screen 900 before such liquids and/or light solids would drain through a customized flange trap, such as customized flange trap 780 or customized flange trap 880. In one embodiment, a drain cover/strainer and/or screen 900 may be configured in such a manner that such a drain cover/strainer would be installed in reshaped floor 700 all the way around the perimeter of toilet base 255, as illustrated in FIG. 19. Thus, there would be a drain cover/strainer 900 installed 360 degrees around toilet base 255 such that any liquids and/or light solids on reshaped floor 700 would have to flow through this 360 degree drain cover/strainer 900 before any of such liquids and/or light solids would flow on through a specialized trap system, such as customized flange trap 780 or customized flange trap 880. This is advantageous as it will assist in preventing any larger matter/materials from flowing through the customized flange trap system. In such an embodiment, the drain cover/strainer and/or screen may be made of any number of materials, such as brass, stainless steel, chrome, PVC, and the like and may comprise any number of shapes, such as circular, oval, square and the like. In addition, such drain cover/strainer may also be configured as one piece or multiple pieces that are configured so that a user can easily remove the drain cover/strainer for easy maintenance.

The present invention provides various advantages and may be used in a variety of settings. For example, the present invention may be utilized in bathrooms in multistory buildings to help prevent and/or reduce the amount of damage resulting from overflow situations occurring on the upper floors of buildings. For example, the present embodiment could be utilized in the bathrooms of hotels, and thus if an overflow situation were to occur in a bathroom of a guest room on the $6^{th}$ floor, the liquids and/or light solids from the overflow situation would drain through the present invention and not leak down through the rooms below and would thus eliminate damage from the overflow situation. The present invention may also be utilized to allow for better use of space in areas of limited spaces. For example, bathrooms in ships and campers are very small and often very crowded. The present invention could be utilized to provide for better use of such limited space. The present invention could be installed and then the shower area of a bathroom on a ship and/or a camper could be larger as the shower and toilet would not have to be separated as liquids and/or light solids from a shower could drain through the toilet drain with the present invention—thus eliminating the need for separate drains for a toilet and a shower in areas of limited space, such as on a ship and/or a camper.

Although the present invention and its advantages have been described in detail, it should be understood that various changes, substitutions and alterations can be made herein without departing from the invention as defined by the appended claims. Moreover, the scope of the present application is not intended to be limited to the particular embodiments of the process, machine, manufacture, composition of matter, means, methods and steps described in the specification. As one will readily appreciate from the disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. A system for draining liquids and/or light solids comprising:

a flange member comprising a lip;

a base member comprising:

a bottom;

a lip; and a pipe member with an upper portion that extends up toward said lip and a bottom portion that extends down below said bottom of said base;

a drainage pipe; and a reshaped floor, wherein said reshaped floor is configured so that said reshaped floor declines towards said drainage pipe.

2. The system of claim 1 wherein said flange member and said pipe member of said base are sized so that said flange member fits over said upper portion of said pipe member in said base so that a space exists between the outer surface of said pipe member and the inner surface of flange member.

3. The system of claim 2 wherein said bottom portion of said pipe member of said base is configured to fit over said drainage pipe.

4. The system of claim 3 wherein said flange member is installed into said base around said pipe member at an elevated position so that a space exists between the top of said upper portion of said pipe member and said lip of said flange member.

5. The system of claim 4 wherein said space existing between the top of said upper portion of said pipe member and said lip of said flange member provides room for liquids and light solids to drain into said drainage pipe.

6. The system of claim 5 wherein:

said lip of said flange member includes at least one hole sized to accommodate a fastening mechanism; and said base member includes at least one receiving member configured to receive a fastening mechanism wherein when said flange member is installed into said base member said hole in said lip of said flange member will align with said receiving member of said base member.

7. The system of claim 6 further comprising:

a toilet wherein said drainage pipe is a drainage pipe for said toilet wherein:

said reshaped floor is configured with a depression near said drainage pipe that provides room for said base member to be installed in said depression wherein when said base member is installed into said depression, said bottom portion of said pipe member of said base member installs over said drainage pipe; and said flange member is installed over said base member and said toilet is installed over said flange member and above said reshaped floor at an elevated position so that there is space between the bottom of said toilet and said reshaped floor whereby said space between the bottom of said toilet and said reshaped floor provides room for liquids and light solids to drain underneath the bottom of said toilet and into said base member wherein said toilet is secured to said base member with a fastening mechanism that extends through a hole in a base of said toilet down through said hole in said lip of said flange member and fits into said receiving member in said base configured to receive a fastening mechanism.

8. The system of claim 7 further comprising a flushing system that flushes said base member wherein said base member is configured to include at least one flush hole wherein said flushing system flushes said base through said flush hole.

9. The system of claim 7 wherein said base member and said flange member are configured to provide trap system functionality so that when drainage occurs through said space existing between the bottom of said toilet and said reshaped floor, drainage will continue to flow into said base then up through space existing between the outer surface of said pipe member and the inner surface of flange member then through said space existing between the top of said upper portion of said pipe member and said lip of said flange member into said pipe member and then into said drainage pipe whereby a minimal amount of drainage substance will remain in said base member in order to prevent sewerage gasses from said drainage pipe from flowing back through said space existing between the bottom of said toilet and said reshaped floor.

10. The system of claim 5 further comprising:

a toilet wherein said drainage pipe is a drainage pipe for said toilet wherein:

said reshaped floor is configured with a depression near said drainage pipe that provides room for said base member to be installed in said depression wherein when said base member is installed into said depression, said bottom portion of said pipe member of said base member installs over said drainage pipe; and said reshaped floor is further configured with a drain cover installed near said toilet so that drainage on said reshaped floor would drain through said drain cover and into said base member.

* * * * *